US007874809B2

(12) United States Patent
Kamata et al.

(10) Patent No.: US 7,874,809 B2
(45) Date of Patent: Jan. 25, 2011

(54) WATER-LIFTING PUMP APPARATUS AND METHOD FOR CONTROLLING OPERATION THEREOF

(75) Inventors: Isamu Kamata, Tokyo (JP); Shinji Suzuki, Tokyo (JP); Hideki Kanno, Tokyo (JP); Takashi Enomoto, Tokyo (JP); Masahiro Kuramasu, Tokyo (JP)

(73) Assignee: Ebara Corporation, Tokyo (JP)

( * ) Notice: Subject to any disclaimer, the term of this patent is extended or adjusted under 35 U.S.C. 154(b) by 1277 days.

(21) Appl. No.: 10/574,657

(22) PCT Filed: Oct. 6, 2004

(86) PCT No.: PCT/JP2004/014740

§ 371 (c)(1),
(2), (4) Date: Apr. 4, 2006

(87) PCT Pub. No.: WO2005/040616

PCT Pub. Date: May 6, 2005

(65) Prior Publication Data

US 2007/0122290 A1 May 31, 2007

(30) Foreign Application Priority Data

Oct. 7, 2003 (JP) ..... 2003-348782

(51) Int. Cl.
*F04B 49/02* (2006.01)
*F04B 49/08* (2006.01)

(52) U.S. Cl. ..... 417/38; 417/36; 417/43; 417/44.2

(58) Field of Classification Search ..... 417/12, 417/44.2, 36, 38, 43; 415/148, 151; 318/3
See application file for complete search history.

(56) References Cited

U.S. PATENT DOCUMENTS 3,172,567 A * 3/1965 Deters et al. ..... 222/52

(Continued)

FOREIGN PATENT DOCUMENTS

JP 5-180187 7/1993

(Continued)

OTHER PUBLICATIONS

International Search Report of PCT/JP2004/014740 dated Feb. 23, 2005.

(Continued)

*Primary Examiner*—Devon C Kramer
*Assistant Examiner*—Patrick Hamo
(74) *Attorney, Agent, or Firm*—Westerman, Hattori, Daniels & Adrian, LLP

(57) ABSTRACT

A water-lifting pump apparatus which is free of a discharge valve and a check valve, is low in cost, and is capable of reducing vibration and noise due to a waterfall after the end of water pumping operation. The water-lifting pump apparatus has a suction tank (10), a discharge tank (20), a pump (30) for pumping water in the suction tank (10) into the discharge tank (20), and a discharge piping (50) connected to a discharge side of the pump, an actuator (60) for actuating the pump (50), a reverse flow preventing mechanism (80) for preventing a reverse flow of water pumped into the discharge tank (20) toward the discharge piping (50), and a back flow rate control (90) for controlling the flow rate of a waterfall falling from the discharge piping (50) into the suction tank (10) when pumping operation is finished.

6 Claims, 25 Drawing Sheets

U.S. PATENT DOCUMENTS

| | | | | | |
|---|---|---|---|---|---|
| 4,072,168 | A | * | 2/1978 | Wittenmyer | 137/565.33 |
| 4,281,968 | A | * | 8/1981 | Akers | 417/2 |
| 4,945,942 | A | * | 8/1990 | Lund | 137/337 |
| 5,577,895 | A | * | 11/1996 | Franklin et al. | 417/238 |

FOREIGN PATENT DOCUMENTS

| | | | |
|---|---|---|---|
| JP | 5-180187 | A | 7/1993 |
| JP | 7-89282 | B2 | 9/1995 |
| JP | 2797822 | | 7/1998 |
| JP | 2797822 | B2 | 7/1998 |
| JP | 2808383 | | 7/1998 |
| JP | 2808383 | B2 | 7/1998 |
| JP | 10-299686 | | 11/1998 |
| JP | 10-299686 | A | 11/1998 |
| JP | 2000-345991 | | 12/2000 |
| JP | 2000-345991 | A | 12/2000 |

OTHER PUBLICATIONS

Translation of the International Preliminary Report on Patentability of International Application No. PCT/JP 2004/014740, with Form PCT/IPBA/409.

* cited by examiner

WATER-LIFTING PUMP APPARATUS AND METHOD FOR CONTROLLING OPERATION THEREOF

TECHNICAL FIELD

The present invention relates to a water-lifting pump apparatus suitable for use in a rainwater discharge pump station or the like and a method of controlling operation of the water-lifting pump apparatus.

BACKGROUND ART

As more and more efforts have been made in recent years for utilizing deep underground regions in urban areas, there have been trends towards rainwater discharge pump stations also installed in deep subterranean regions. A typical water-lifting pump apparatus for use in such rainwater discharge pump stations has a discharge valve and a check valve that are connected to a discharge side of the pump. FIG. 1 is a schematic view showing a conventional water-lifting pump apparatus for use in a deep subterranean discharge pump station. As shown in FIG. 1, the conventional water-lifting pump apparatus is of a general structure which includes a pump 300 having an suction piping 301 connected to a suction tank 310 and a discharge piping 303 connected to a discharge tank 330. The pump 300 is connected to an actuator 370 in the form of an internal combustion engine through a transmission (speed reducer) 350. The discharge piping 303 is provided with a check valve 305 and a discharge valve 307. When rain falls, the actuator 370 is driven to start operating the pump 300, thereby pumping the rainwater that has flowed into the suction tank 310 through the suction piping 301 and the discharge piping 303 into the discharge tank 310.

In the water-lifting pump apparatus, the discharge valve 307 is installed in the discharge piping 303 for the following reasons (1) through (3):

(1) Water in the discharge piping 303 and water in a downstream region (on the discharge tank 330 side) of the discharge piping 303 are prevented from flowing back when the pump is stopped or inspected for maintenance.

(2) With the discharge valve 307 being closed, the pump 300 is driven, and after the operation of the pump 300 is completed, the discharge valve 307 is gradually opened to reduce abrupt flow rate variations.

(3) The opening of the valve body of the discharge valve 307 is controlled to control the flow rate.

In the water-lifting pump apparatus, the check valve 305 is installed in the discharge piping 303 in order to prevent water in the discharge piping 303 and water in the downstream region (on the discharge tank 330 side) of the discharge piping 303 from flowing back in case of an emergency shutdown with the discharge valve 307 being open after the pump 300 has operated.

For reducing construction costs of deep subterranean discharge pump stations incorporating the above water-lifting pump apparatus, it is effective to reduce an amount of excavating civil work. In order to reduce an amount of excavating civil work, it is effective to place a pump, valves, and pipings in a compact layout in the pump station, thereby reducing a planar space required in the pump station. In the above discharge pump station, particularly, reducing the valves including the discharge valve 307 and the check valve 305 to make the required space compact is highly effective to reduce an amount of excavating civil work.

FIG. 2 is a schematic view showing another conventional water-lifting pump apparatus which is free of both an discharge valve and a check valve. Those parts of the water-lifting pump apparatus shown in FIG. 2, which are identical or equivalent to those shown in FIG. 1, are denoted by identical reference characters. The water-lifting pump apparatus shown in FIG. 2 differs from the water-lifting pump apparatus shown in FIG. 1 in that the discharge piping 303 has a siphonic piping 303*a*, rather than the check valve 305 and the discharge valve 307, with a siphon break valve 309 being connected to the crest of the siphonic piping 303*a*, and an actuator 370 in the form of an electric motor is used in place of the actuator 370 in the form of an internal combustion engine.

When the pump 300 is stopped (also in case of an emergency shutdown) or inspected for maintenance, the siphon break valve 309 is opened to introduce atmospheric air into the siphonic piping 303*a* of the discharge piping 303, causing a siphon break thereby to prevent water from flowing back in the discharge piping 303. In this water-lifting pump apparatus, when remaining water in the discharge piping 303 falls freely, the pump 300 rotates reversely at a high speed. Internal combustion engines (diesel engines, gas turbines, etc.) are not allowed to rotate reversely to a large extent. If internal combustion engines are reversed in the absence of any countermeasures, then they will be damaged by the. reversing torque. Therefore, the water-lifting pump apparatus employs, as the actuator 370, an electric motor that is free of mechanical problems due to the reversing operation.

However, using the electric motor as the actuator is more costly for the reason of general economic efficiency than using the internal combustion engine as the actuator because the electric motor needs a separate non-utility power generation facility in order to keep electric power in case of interruption of electric service.

In the water-lifting pump apparatus, water in discharge piping 303 falls freely, and the reverse flow in the pump 300 is not controlled. Therefore, the pump 300 and the actuator 370 rotate reversely freely. As the depth of the water-lifting pump apparatus installed is greater, i.e., as the pump head is greater and thereby the energy consumed is larger, the pump 30 and the pipings 301, 303, or the civil engineering structure associated with the pump 300, is excessively affected in the form of large vibrations. If they are affected much more greatly, then the components could be damaged. When the pump 300 and the actuator 370 are reversed and the water flows back in the discharge piping 303, the components produce excessive noise, making people feel uncomfortable and anxious.

DISCLOSURE OF INVENTION

The present invention has been made in view of the above problems. It is an object of the present invention to provide a water-lifting pump apparatus which is free of a discharge valve and a check valve, is low in cost, and is capable of reducing vibration and noise due to a waterfall after the end of water pumping operation, and a method of controlling operation of the water-lifting pump apparatus.

In order to achieve the above object, a water-lifting pump apparatus according to the present invention has a suction tank, a discharge tank, a pump for pumping water in the suction tank into the discharge tank, and a discharge piping connected to a discharge side of the pump, an actuating means for driving the pump, a reverse flow preventing mechanism for preventing a reverse flow of water pumped into the discharge tank toward the discharge piping, and a back flow rate control means for controlling the flow rate of a waterfall falling from the discharge piping into the suction tank when pumping operation is finished.

According to the present invention, with the reverse flow preventing mechanism being provided for preventing a reverse flow of water pumped into the discharge tank toward the discharge piping, it is not necessary to have valves such as an discharge valve, a check valve, etc. installed in the discharge piping. The water-lifting pump mechanism is thus made compact, and the amount of excavating civil work is reduced. Therefore, the construction costs of a deep subterranean discharge pump station incorporating a water-lifting pump apparatus can effectively be lowered. At the same time, the back flow rate control means controls the flow rate of a waterfall falling from the discharge piping into the suction tank, thereby preventing water in the discharge piping from falling freely at once. The actuating means may thus comprise an internal combustion engine which is not allowed to rotate reversely. Even if the water-lifting pump apparatus is installed in a deep subterranean region and has a large pump head, the waterfall has a reduced effect on the pump and the suction piping or the discharge piping, or a civil engineering structure associated with the pump, and hence holds vibration and noise to a problem-free range.

The reverse flow preventing mechanism may comprise an overflow mechanism having a dam disposed in the discharge tank, a reverse flow prevention valve disposed on a distal end of the discharge piping, or a siphonic piping disposed in the discharge piping.

The reverse flow preventing mechanism can thus be simple in structure.

In a preferred aspect of the present invention, the back flow rate control means controls a rotational speed of the pump while keeping the pump rotating in a normal direction.

In this manner, the characteristics of a range, in which water flows back when the pump rotates in the normal direction, are utilized for easily and reliably controlling the flow rate of water falling from the discharge piping into the suction tank.

In a preferred aspect of the present invention, the water-lifting pump apparatus may further have a bypass piping interconnecting an upstream side and a downstream side of the pump in bypassing relation to the pump, and the back flow rate control means may adjust the flow rate of the waterfall falling through the bypass piping and control a rotational speed of the pump while keeping the pump rotating in a normal direction.

Since the water level in the discharge piping is maintained and controlled mainly by controlling the rotational speed of the pump, and the waterfall passes mainly through the bypass piping, the flow rate of the waterfall flowing back in the pump is reduced.

Preferably, the rotational speed of the pump may be controlled so that the waterfall does not pass through the pump.

When the waterfall does not pass through the pump, i.e., when all the waterfall passes through the bypass piping, the waterfall is prevented from flowing back in the pump, and hence vibrations are prevented from increasing due to a reverse flow of the waterfall in the pump.

In a preferred aspect of the present invention, the pump may have a movable vane mechanism for adjusting the vane angle of an impeller, and the back flow rate control means may adjust the vane angle of the impeller.

If the pump has a movable vane mechanism for adjusting the vane angle of an impeller, then the vane angle of the impeller is controlled to reduce the pump head, providing the same effect as if the rotational speed of the pump is lowered, so that the water head drop can be reduced even if the rotational speed of the pump is constant.

In a preferred aspect of the present invention, the water-lifting pump apparatus may further has a reversal prevention device for preventing the actuating means from being reversed.

The actuating means is prevented from being reversed by the reversal prevention device in case of an emergency shutdown of the water-lifting pump apparatus, for example. Therefore, the actuating means may comprise an internal combustion engine such as a diesel engine, a gas turbine, or the like, which is not allowed to rotate reversely to a large extent, that does not need a separate non-utility power generation facility, or an electric motor which is now allowed to rotate reversely because of the structure of the engine and bearings or the like.

According to the present invention, a method of controlling operation of a water-lifting pump apparatus for pumping water in a suction tank into a discharge tank with a pump and a discharge piping connected to a discharge side of the pump, comprises, after the pumping operation is finished, controlling a rotational speed of the pump while keeping the pump rotating in a normal direction, thereby to control the flow rate of a waterfall falling from the discharge piping into the suction tank.

By thus keeping the pump rotating in the normal direction after the pumping operation is finished, the flow rate of the waterfall falling from the discharge piping into the suction tank can easily be controlled.

Preferably, the method may comprise, after the pumping operation is finished, reducing the rotational speed of the pump, which rotates in the normal direction, thereby to lower the water level of water in the discharge piping or the discharge tank.

The rotational speed of the pump is controlled while keeping the pump rotating in the normal direction, and when the falling of water is completed or the effect that a reverse flow of water has on the reversal of the pump is reduced, the pump is shut off.

According to the present invention, another method of controlling operation of a water-lifting pump apparatus for pumping water in a suction tank into a discharge tank with a pump and a discharge piping connected to a discharge side of the pump, comprises, after the pumping operation is finished, causing water in the discharge piping to fall into the suction tank through a bypass piping interconnecting an upstream side and a downstream side of the pump, and, simultaneously, controlling a rotational speed of the pump while keeping the pump rotating in a normal direction.

Since the water level in the discharge piping is maintained and controlled mainly by controlling the rotational speed of the pump, and the waterfall passes mainly through the bypass piping, the flow rate of the waterfall flowing back in the pump is reduced.

Preferably, the rotational speed of the pump, which rotates in the normal direction after the pumping operation is finished, may be a rotational speed for maintaining the lowering water level in the discharge piping each time the water level is lowered.

In this manner, with the waterfall passes mainly through the bypass piping, the flow rate of the water falling into the suction tank can easily be controlled.

BEST MODE FOR CARRYING OUT THE INVENTION

Embodiments of the present invention will be described in detail below with reference to the drawings.

Figure 1:
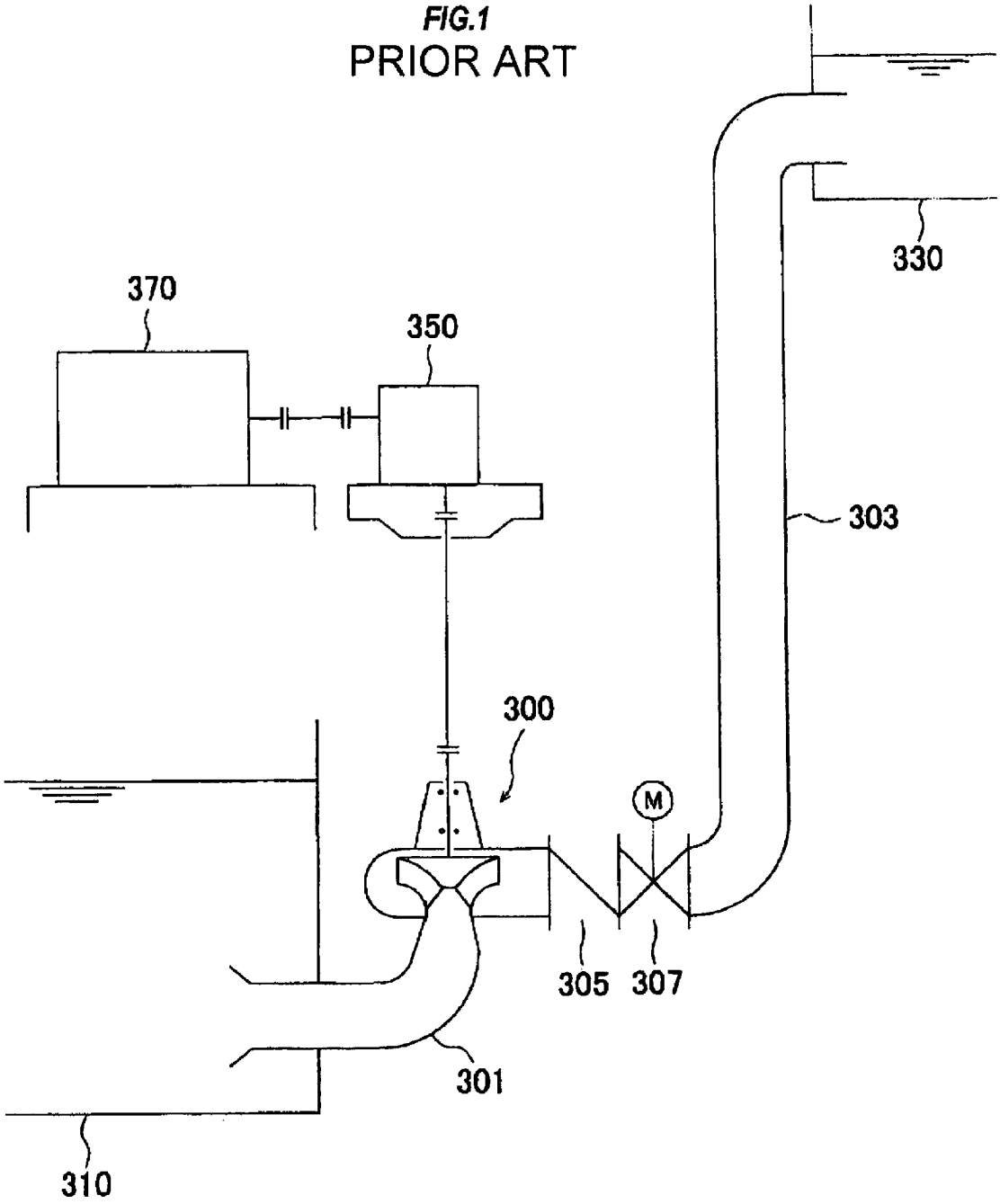
FIG.1 PRIOR ART
FIG. 1 is a schematic view showing a conventional water-lifting pump apparatus for use in a deep subterranean discharge pump station.
Figure 2:
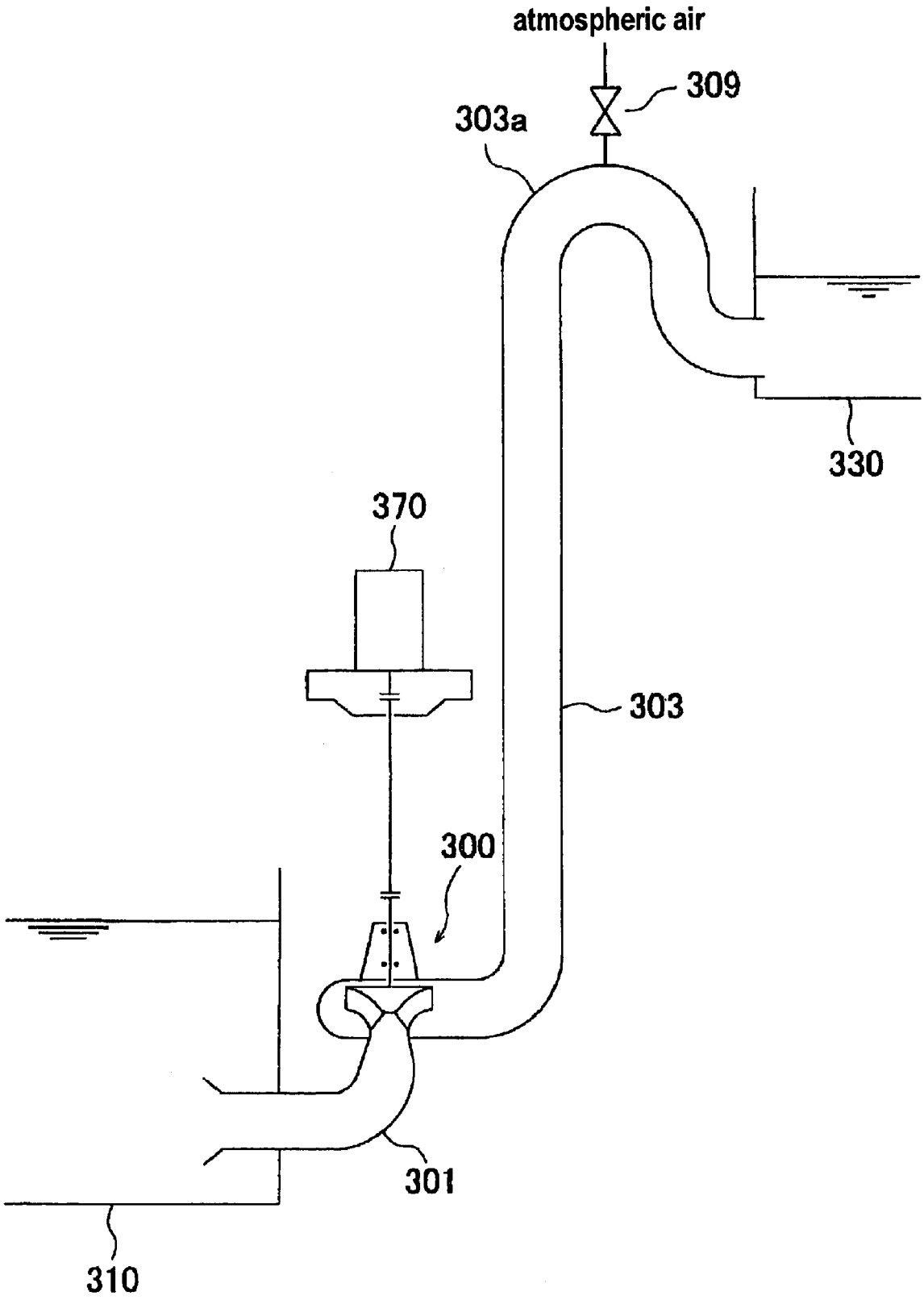
FIG.2 PRIOR ART
FIG. 2 is a schematic view showing another conventional water-lifting pump apparatus for use in a deep subterranean discharge pump station.
Figure 3:
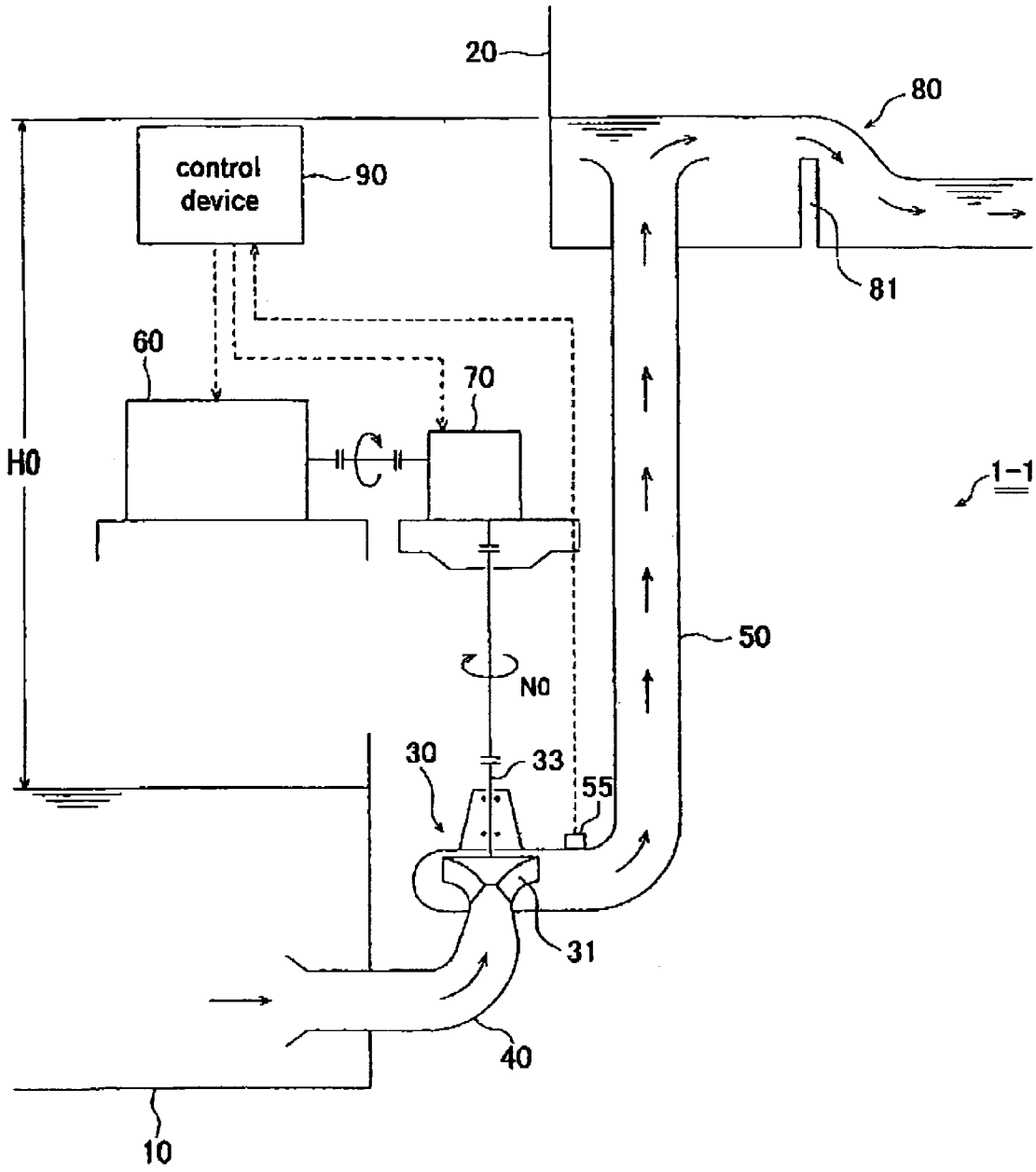
FIG. 3 is an overall schematic view of a water-lifting pump apparatus according to an embodiment of the present invention, showing the manner in which the water-lifting pump apparatus pumps water (pump rotational speed N0)

FIG. 3 is an overall schematic view of a water-lifting pump apparatus 1-1 according to an embodiment of the present invention.

The water-lifting pump apparatus 1-1 shown in FIG. 3 is a water-lifting pump apparatus for use in a deep subterranean water discharge pump station, for example, and has a suction tank 10 for collecting rainwater or the like, a discharge tank 20 installed in a position higher than the suction tank 10, and a pump 30 for pumping water in the suction tank 10 into the discharge tank 20. The water-lifting pump apparatus 1-1 also has an suction piping 40 interconnecting the suction side of the pump 30 and the suction tank 10, a discharge piping 50 interconnecting the discharge side of the pump 30 and the discharge tank 20, an actuating means 60 for driving the pump 30, a transmission (speed reducer) 70 connected between the actuating means 60 and the pump 30 for changing (reducing) the rotational speed of the actuating means 60, an overflow mechanism 80 disposed downstream of a portion of the discharge tank 20 that is connected to an end of the discharge piping 50, and a control device 90 for controlling the rotational speed of the actuating means 60 (or the transmission 70 having a transmission function such as a fluid coupling or the like).

Figure 18:
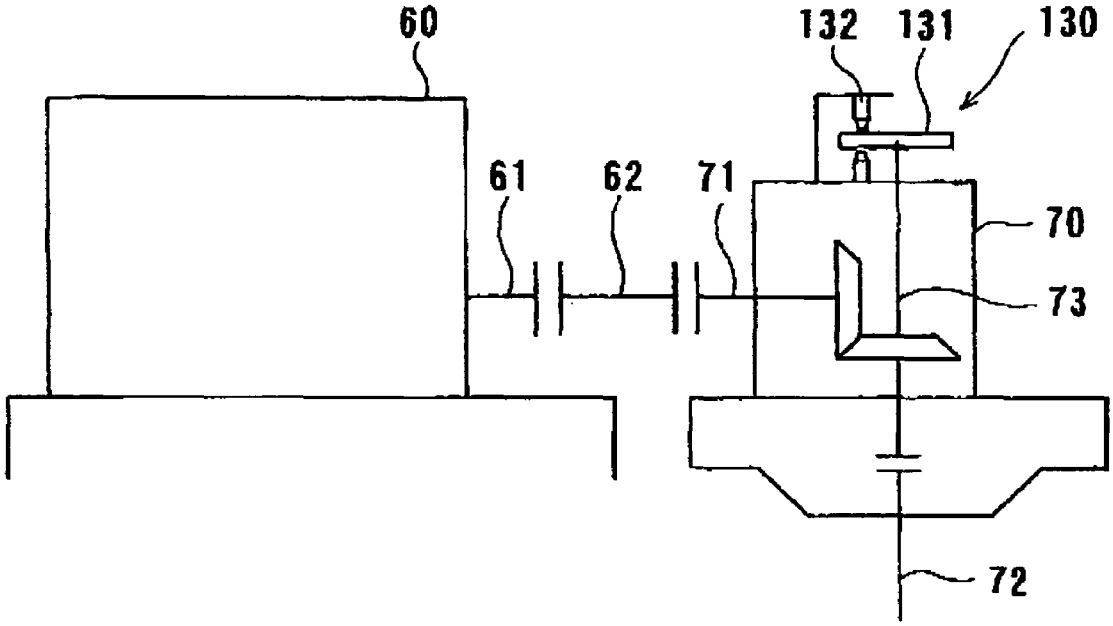
FIG. 18 is a schematic view of a transmission (speed reducer) used in a water-lifting pump apparatus according to the present invention.

The pump 30 has an impeller 31 disposed in a casing, and is rotatable by a pump shaft 33 projecting from the casing. The pump shaft 33 is connected to the transmission (speed reducer) 70. According to the present embodiment, as shown in FIG. 18, the transmission 70 has an input shaft 71 connected to an output shaft 61 of the actuating means 60 via a connecting rod 62, and an output shaft 73 coupled to the pump shaft 33 (see FIG. 3) via a connecting rod 72. In the present embodiment, a reversal prevention device comprising a brake 130 is installed on the transmission 70.

The brake (reversal prevention means) 130 has a brake disk 131 fixed to the upper end of the output shaft 73 which projected upwardly from a housing of the transmission 70, and a pair of brake pads 132 disposed above and below a peripheral edge portion of the brake disk 131. In response to e.g. an actuator emergency stop signal or a stop signal from a low-speed detector which is disposed on an actuator shaft for detecting the rotational speed of the actuator shaft, the brake pads 132 are moved toward each other into pressed contact with the peripheral edge portion of the brake disk 131, stopping the rotation of the output shaft 73 of the transmission 70 thereby to prevent the actuating means 60 from being reversed.

In the present embodiment, since the brake 130 is provided as the reversal prevention means for preventing the actuating means 60 from being reversed, the actuating means 60 may comprise an internal combustion engine such as a diesel engine, a gas turbine, or the like, which is not allowed to rotate reversely to a large extent, that does not need a separate non-utility power generation facility. Alternatively, the actuating means 60 may comprise an electric motor whose rotational speed is controlled by a VVVF or a secondary resistance process, for example. As the brake 130 is provided as the reversal prevention means for preventing the actuating means 60 from being reversed, it is possible to employ an engine or an electric motor which is not allowed to rotate reversely because of the structure of bearings or the like.

The impeller 31 may comprise an impeller with a movable vane mechanism which is capable of adjusting a vane angle. When the vane angle of the impeller is controlled, even if the rotational speed of the pump is constant, the pump head can be reduced, providing the same effect as if the rotational speed of the pump is lowered, so that the water head drop can be reduced.

The discharge piping 50 extends upwardly from the pump 30 and is connected to the discharge tank 20 with its discharge port being open upwardly. Valves including a gate valve and a check valve are not provided in the discharge piping 50.

The overflow mechanism 80 is provided in a downstream region of the discharge tank 20 by a dam 81 that water discharged from the discharge piping 50 overflows. The overflow mechanism 80 serves as a reverse flow preventing mechanism for preventing water pumped into the discharge tank 20 from flowing back into the discharge piping 50. Specifically, the overflow mechanism (reverse flow preventing mechanism) 80 serves to prevent water discharged over the dam 81 toward a drainage destination from flowing back from the drainage destination over the dam 81 into the discharge tank 20 and then back into the discharge piping 50.

The control device 90 controls operation of the actuating means 60 (or the transmission 70 if the transmission 70 has a transmission function such as a fluid coupling or the like) to operate the pump 30 at a desired rotational speed both when the pump 30 pumps water and when the pump 30 does not pump water. The control device 90 doubles as a back flow rate control means for controlling the flow rate of a waterfall tending to flow back in the discharge piping 50, by rotating the pump 30 in a normal direction after its water pumping operation is finished. A pressure detector 55 is disposed in a predetermined position on the discharge piping 50 for detecting the pressure in the discharge piping 50 and converting the detected pressure into a water level (difference). The pressure (water level) in the discharge piping 50 is input to the control device 90 by the pressure detector 50. Rather than the pressure detector 55, water level indicators may be installed for detecting the water level in the discharge tank 20 or the discharge piping 50 and the water level in the suction tank 10, and the detected water levels may be input to the control device 90, respectively.

A method of controlling operation of the water-lifting pump apparatus 1-1 of the above construction will be described below. When the water level in the suction tank 10 reaches a predetermined water level due to a rainfall, for example, the control device 90 drives the actuating means 60, rotating the impeller 31 of the pump 30 at a desired rotational speed N0, as shown in FIG. 3. The water in the suction tank 10 is now pumped through the suction piping 40, the pump 30, and the discharge piping 50 into the discharge tank 20. The water pumped into the discharge tank 20 overflows the dam 81 and is drained to the drainage destination.

Figure 4A:
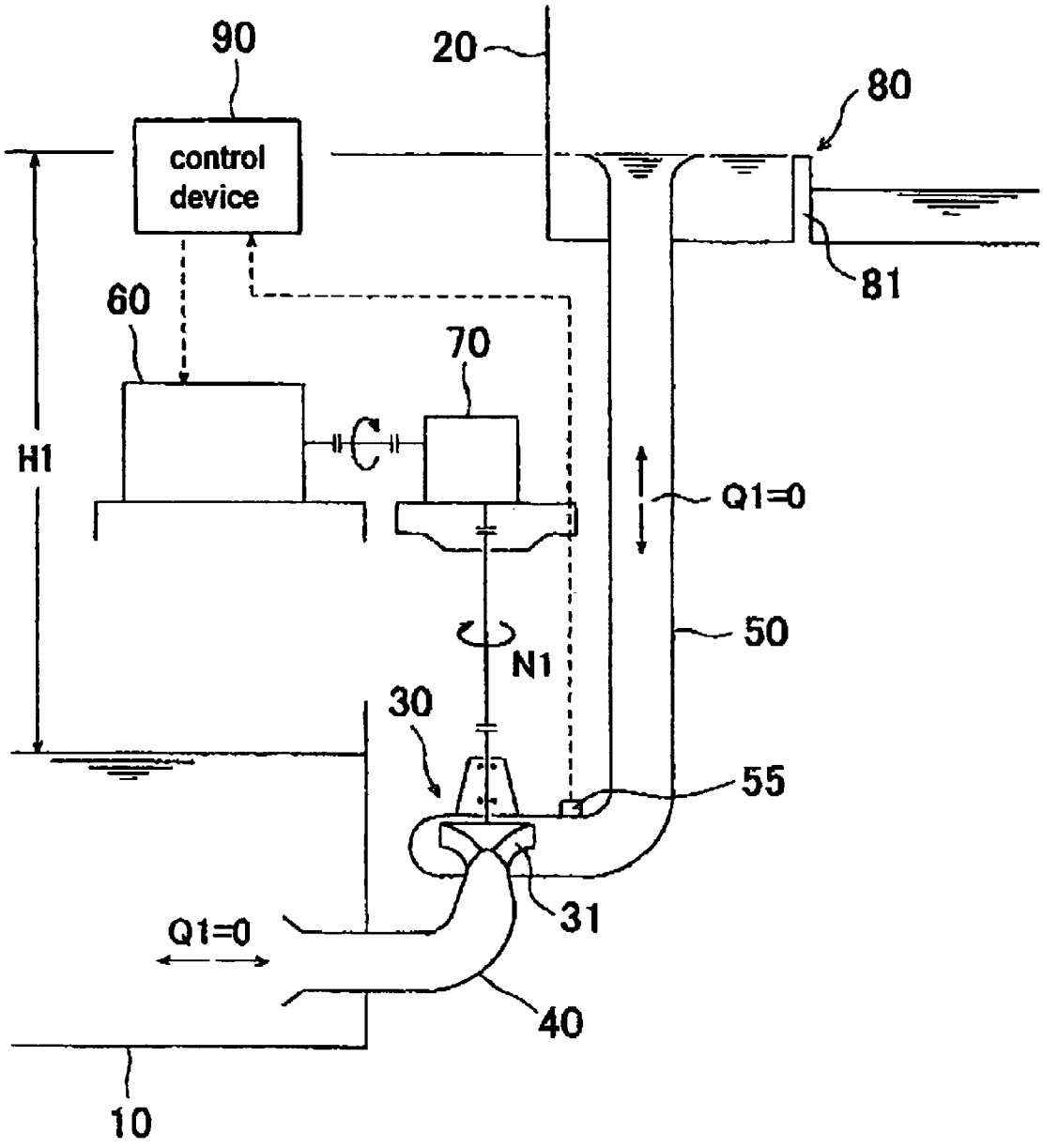
FIG. 4A is a view of the water-lifting pump apparatus shown in FIG. 3, showing the manner in which the pump rotational speed is reduced from N0 to N1.

For finishing the above pumping process for the reason that the water level in the suction tank 10 drops to predetermined water level, the control device 90 reduces the rotational speed of the impeller 31 of the pump 30 from N0 (rotation in the normal direction) to N1 (rotation in the normal direction) (N0>N1) to bring the water level of the water in the discharge piping 50 into alignment with a water level that fills the discharge port of the discharge piping 50 (the water level difference between the water level in the discharge piping 50 and the water level in the suction tank 10: H1), as shown in FIG. 4A. In the present embodiment, since the height of the discharge port of the discharge piping 50 is the same as the height of the dam 81, the water level in the discharge piping 50 is the same as the water level of the water that is left in the discharge tank 20 by the dam 81. Stated otherwise, the control device 90 controls the rotational speed of the impeller 31 so that water level in the discharge piping 50 is the same as the water level of the water that fills the discharge port. The flow rate Q1 of the water that moves in the discharge piping 50 toward the discharge side and the suction side is Q1=±0.

Figure 4B:
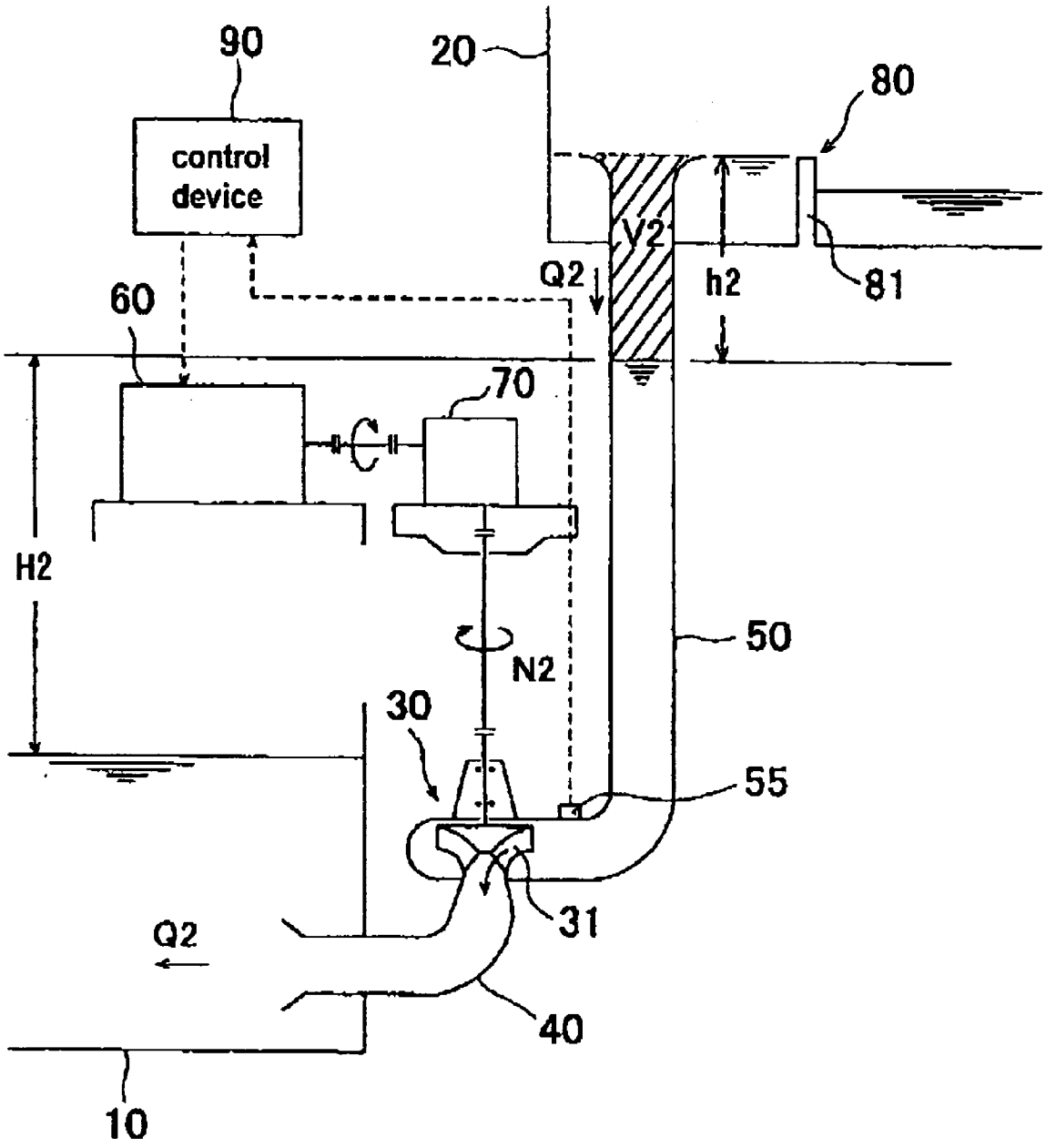
FIG. 4B is a view of the water-lifting pump apparatus shown in FIG. 3, showing the manner in which the pump rotational speed is reduced from N1 to N2.

If the pressure detector 55 detects when the water level difference between the water level in the discharge piping 50 and the water level in the suction tank 10 becomes H1, then the control device 90 reduces the rotational speed of the impeller 31 of the pump 30 from N1 (rotation in the normal direction) to N2 (rotation in the normal direction) (N1>N2) to bring the water level of the water in the discharge piping 50 to a position that is lower than the discharge port of the discharge piping 50 by a water head drop h2, causing as much water as the water head drop h2 (total reverse flow volume V2) to flow back at a back flow rate Q2 into the suction tank 10, as shown in FIG. 4B. The water level difference between the water level of the water in the discharge piping 50 and the water level of the water in the suction tank 10 now becomes H2 (H1>H2). Since the total reverse flow volume V2 of the reversing water flow is considerably smaller than the total amount of water in the discharge piping 50, the back flow rate Q2 is small, and no problem arises even if water flows back through the pump 30 which is rotating in the normal direction. Stated otherwise, the control device 90 controls the rotational speed of the impeller 31 of the pump 30 in order to achieve the back flow rate Q2 which poses no problem even if water flows back through the pump 30 which is rotating in the normal direction.

Figure 5A:
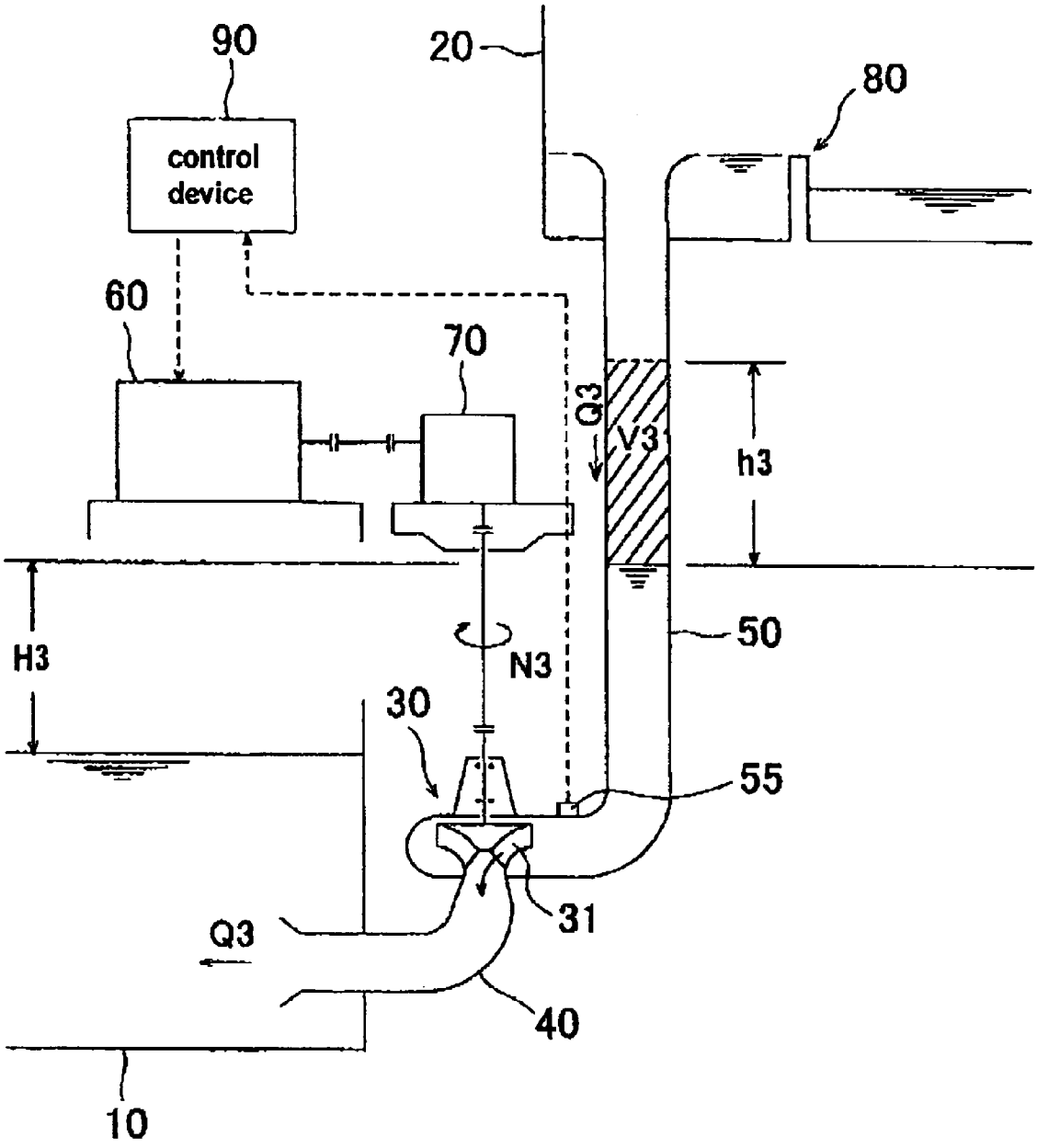
FIG. 5A is a view of the water-lifting pump apparatus shown in FIG. 3, showing the manner in which the pump rotational speed is reduced from N2 to N3.

Similarly, if the pressure detector 55 detects when the water level difference between the water level in the discharge piping 50 and the water level in the suction tank 10 becomes H2, then the control device 90 reduces the rotational speed of the impeller 31 of the pump 30 from N2 (rotation in the normal direction) to N3 (rotation in the normal direction) (N2>N3) to lower the water level of the water in the discharge piping 50 further by a water head drop h3, causing as much water as the water head drop h3 (total reverse flow volume V3) to flow back at a back flow rate Q3 into the suction tank 10, as shown in FIG. 5A. The water level difference between the water level of the water in the discharge piping 50 and the water level of the water in the suction tank 10 now becomes H3 (H2>H3). Since the total reverse flow volume V3 of the reversing water flow is considerably smaller than the total amount of water in the discharge piping 50, the back flow rate Q3 is small, and no problem arises even if water flows back through the pump 30 which is rotating in the normal direction. Stated otherwise, the control device 90 controls the rotational speed of the impeller 31 of the pump 30 in order to achieve the back flow rate Q3 which poses no problem even if water flows back through the pump 30 which is rotating in the normal direction.

Figure 5B:
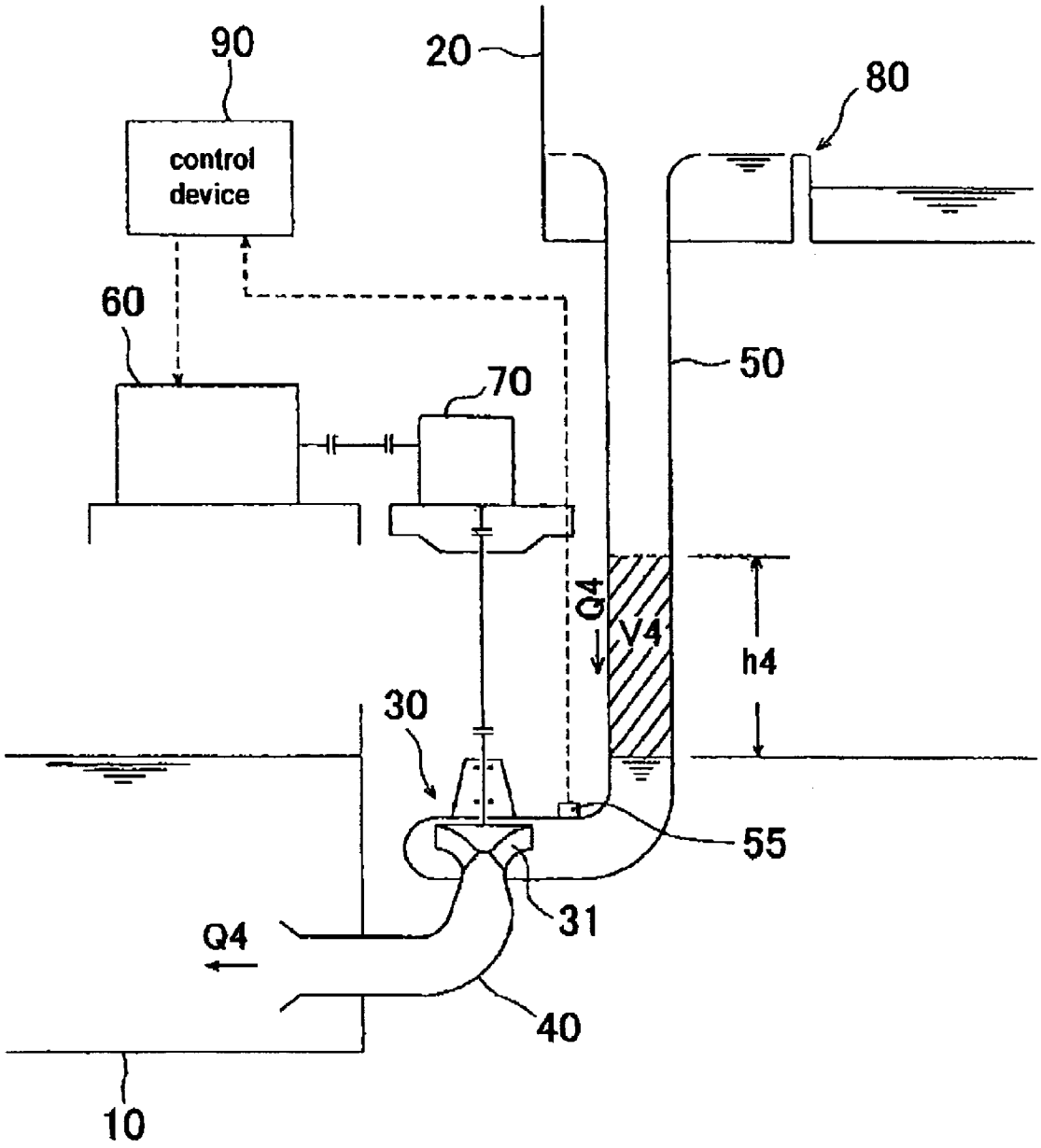
FIG. 5B is a view of the water-lifting pump apparatus shown in FIG. 3, showing the manner in which the pump rotational speed is reduced from N3 to zero.

If the pressure detector 55 detects when the water level difference between the water level in the discharge piping 50 and the water level in the suction tank 10 becomes H3, then the control device 90 stops or gradually stops the impeller 31 of the pump 30 against rotation, causing as much water as the water level difference H3 to flow back into the suction tank 10, as shown in FIG. 5B. The water level difference between the water level of the water in the discharge piping 50 and the water level of the water in the suction tank 10 now becomes 0. Since the total reverse flow volume V4 of the water that falls at this time is considerably smaller, the back flow rate Q4 is small, and no problem arises even if water flows back through the pump 30 which is rotating in the normal direction (or stopping).

Figure 6:
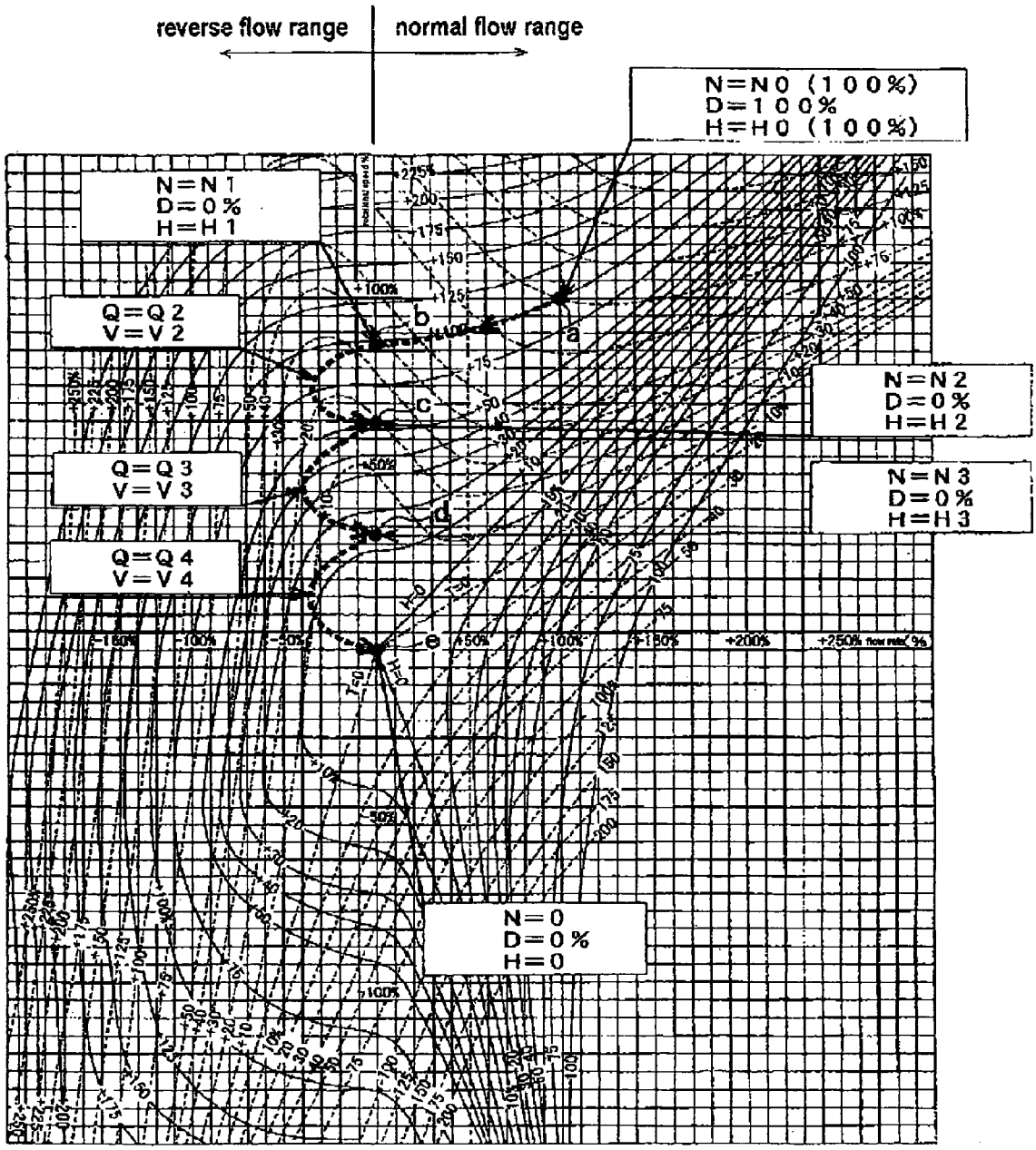
FIG. 6 is a diagram showing a method of controlling operation of the water-lifting pump apparatus shown in FIG. 3, on pump complete characteristic curves.

FIG. 6 is a diagram showing the above controlling method on pump complete characteristic curves. In FIG. 6, the solid-line curves represent constant water head curves, the broken-line curves constant torque curves, respectively, and the numerical values show percentages with respect to values in normal operation.

In the pumping process, an operating point "a" occurs at a pump rotational speed N=N0 (100%), a pump displacement D=100%, and a full pump head H=H0 (100%), as shown in FIG. 3. When the pumping process is finished, causing at a pump rotational speed N=N1 (100%), a pump displacement D=0%, and a full pump head H=H1, the operating point changes to "b", and the water in the discharge piping 50 flows neither in the normal direction nor in the reverse direction though the pump 30 is operating. At a pump rotational speed N=N2 (100%), a pump displacement D=0%, and a full pump head H=H2, the operating point changes to "c". During this time, the water in the discharge piping 50 partly flows back, and as much water as the total reverse flow volume V=V2 flows back into the suction tank 10 (the reverse flow rate Q=Q2). Then, at a pump rotational speed N=N3 (100%), a pump displacement D=0%, and a full pump head H=H3, the operating point changes to "d". During this time, the water in the discharge piping 50 partly flows back, and as much water as the total reverse flow volume V=V3 flows back into the suction tank 10 (the reverse flow rate Q=Q3). Then, at a pump rotational speed N=0 (100%), a pump displacement D=0%, and a full pump head H=0, the operating point changes to "e". During this time, the remaining water in the discharge piping 50 flows back in its entirety, and as much water as the total reverse flow volume V=V4 flows back into the suction tank 10 (the reverse flow rate Q=Q4).

By thus controlling the back flow rate at which water falls in the discharge piping 50, it is possible to cause the water to flow back into the pump 30 without reversing the impeller 31 of the pump 30, i.e., without reversing the actuating means 60. Therefore, an internal combustion engine, which is not allowed to rotate reversely to a large extent, can be used as the actuating means 60. Even if the water-lifting pump apparatus is installed in a deep subterranean region and has a large pump head, the waterfall has a reduced effect on the pump 30 and the suction piping 40 and the discharge piping 50, or the civil engineering structure associated with the pump 30, and hence produces reduced vibration and noise.

Figure 7:
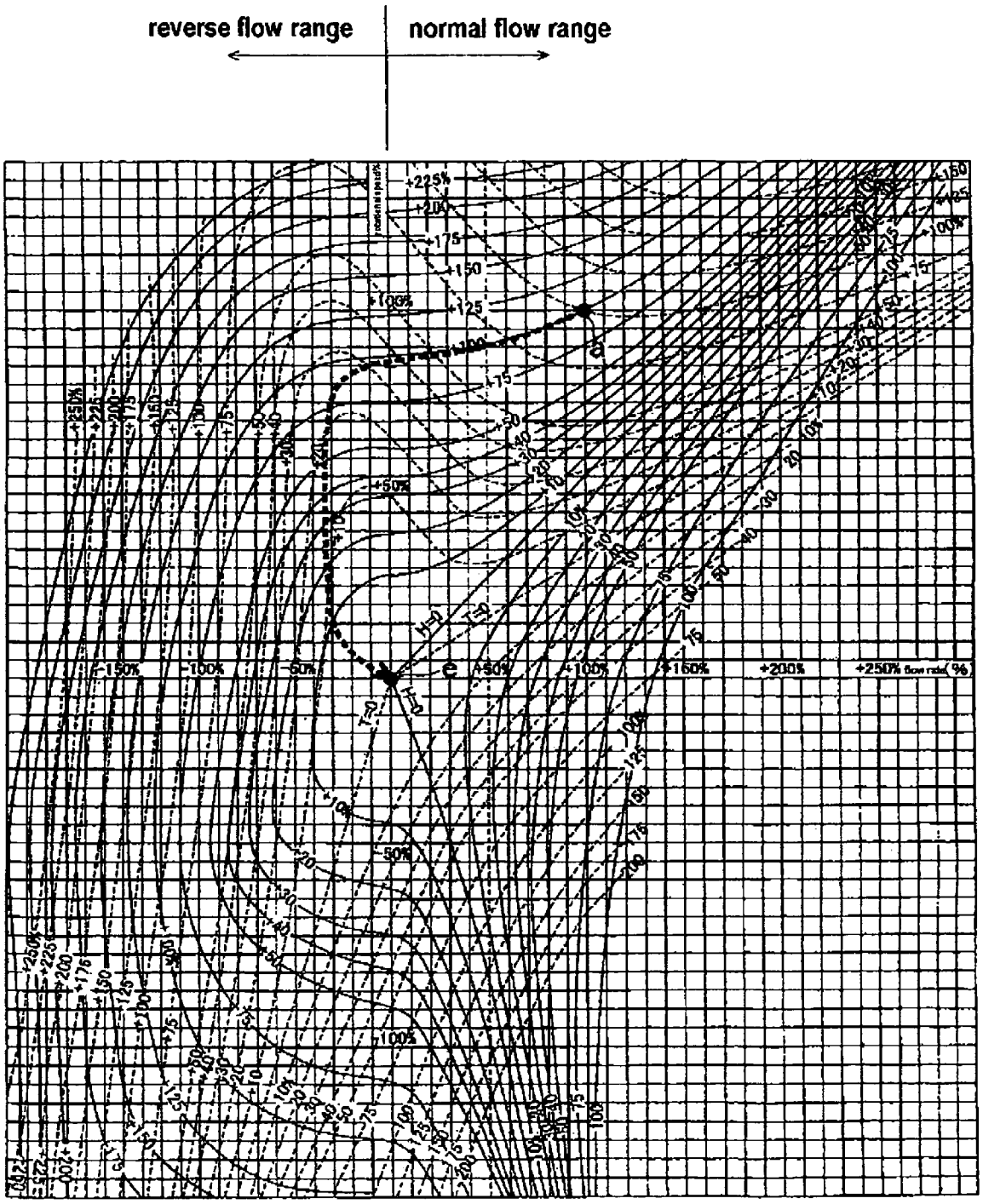
FIG. 7 is a diagram showing another method of controlling operation of the water-lifting pump apparatus shown in FIG. 3, on pump complete characteristic curves.

According to the above controlling method, a stepwise control process is carried out to lower the water level stepwise in the discharge piping 50 while stopping the water level at a plurality of positions. Alternatively, a continuous control process may be carried out to lower the water level continuously in the discharge piping 50. According to the continuous control process, the rotational speed of the pump 30 as it rotates in the normal direction may be continuously lowered gradually to continuously lower the water level gradually in the discharge piping 50. FIG. 7 shows the continuous control process on pump complete characteristic curves. Specifically, in the pumping process, the operating point is represented by "a". The pump rotational speed is continuously lowered gradually such that the water falls in the discharge piping 50 at a constant flow rate, and the pump 30 is stopped when all the water in the discharge piping 50 falls into the suction tank 10.

According to the above embodiment, the pressure in the discharge piping 50 is detected and converted into a water level (difference), and the result is input to the control device 90, which establishes a pump rotational speed depending on the water level (difference) and the elapsed time (a time that has elapsed after the pumping operation ended), thereby controlling the pump. However, rather than the pressure detector 50, flow rate detectors may be installed on the pump 30, the discharge piping 50 and the like for directly detecting flow rates of the waterfall flowing through the pump 30, the discharge piping 50 and the like, and a pump rotational speed may be established depending on the detected back flow rates and the elapsed time for controlling the pump. Further alternatively, no detectors may be installed, but a relationship between elapsed times and pump rotational speeds may be established in advance, and the pump may be controlled to rotate at a rotational speed corresponding to a preset elapsed time in advance after the pumping process ended.

Figure 8:
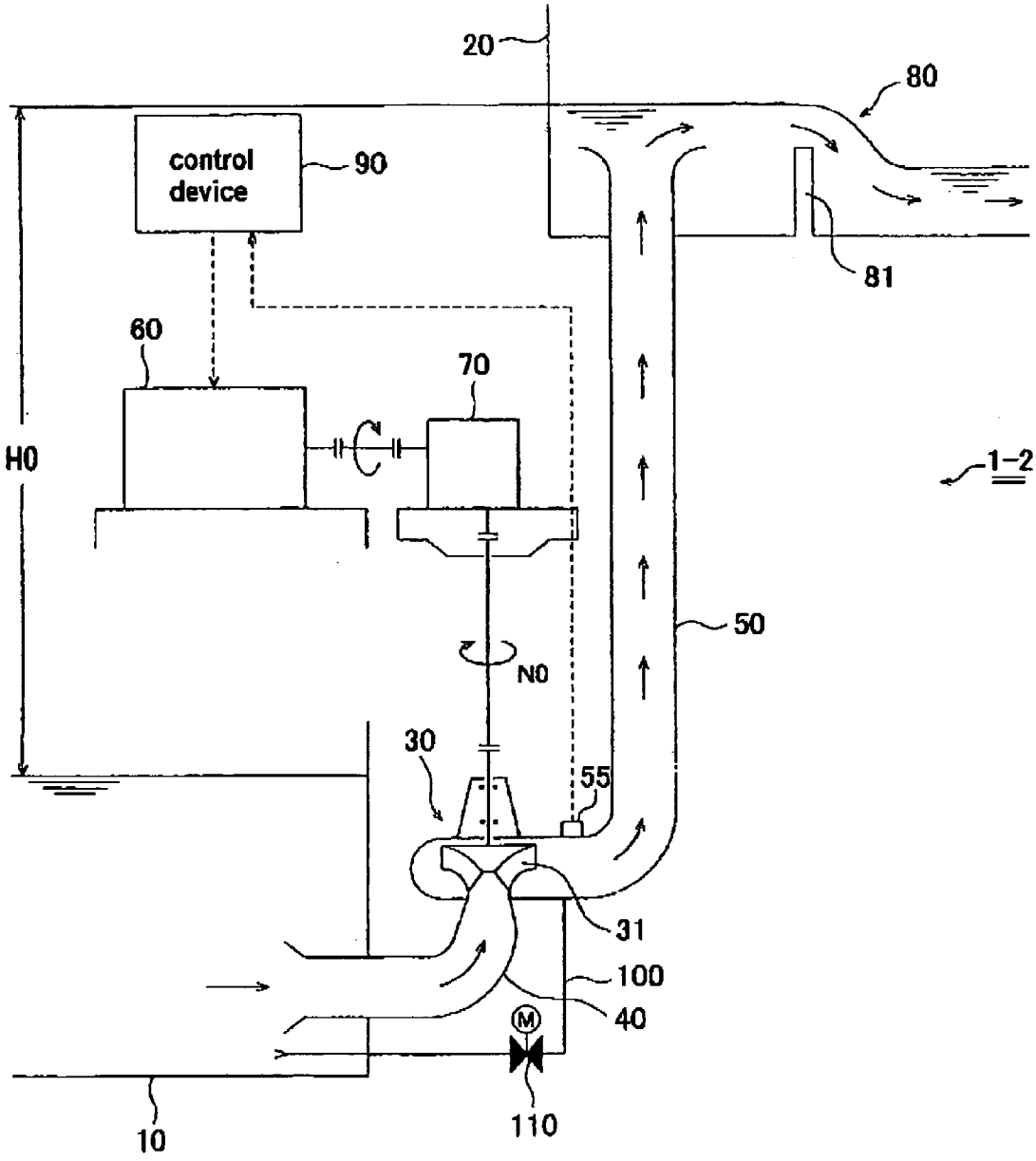
FIG. 8 is an overall schematic view of a water-lifting pump apparatus according to another embodiment of the present invention, showing the manner in which the water-lifting pump apparatus pumps water (pump rotational speed N0)

FIG. 8 is an overall schematic view of a water-lifting pump apparatus 1-2 according to another embodiment of the present invention. Those parts of the water-lifting pump apparatus 1-2 shown in FIG. 8, which are identical to those of the water-lifting pump apparatus 1-1, are denoted by identical reference characters, and will not be described in detail below. The water-lifting pump apparatus 1-2 differs from the water-lifting pump apparatus 1-1 in that it has a bypass piping 100 interconnecting a region upstream of the pump 30 (the suction tank 10) and a region downstream of the pump 30 (the discharge piping 50) in bypassing relation to the pump 30, and a back flow rate regulating valve 110 for regulating the flow rate of the waterfall passing through the bypass piping 100. The back flow rate regulating valve 110 is controlled to be opened and closed by the control device 90.

A method of controlling operation of the water-lifting pump apparatus 1-2 will be described below. Normally, the back flow rate regulating valve 110 is closed. When the water level in the suction tank 10 reaches a predetermined water level due to a rainfall, for example, the control device 90 drives the actuating means 60, rotating the impeller 31 of the pump 30 at a desired rotational speed N0, as shown in FIG. 8. The water in the suction tank 10 is now pumped through the suction piping 40, the pump 30, and the discharge piping 50 into the discharge tank 20. The water pumped into the discharge tank 20 overflows the dam 81 and is drained to the drainage destination.

Figure 9A:
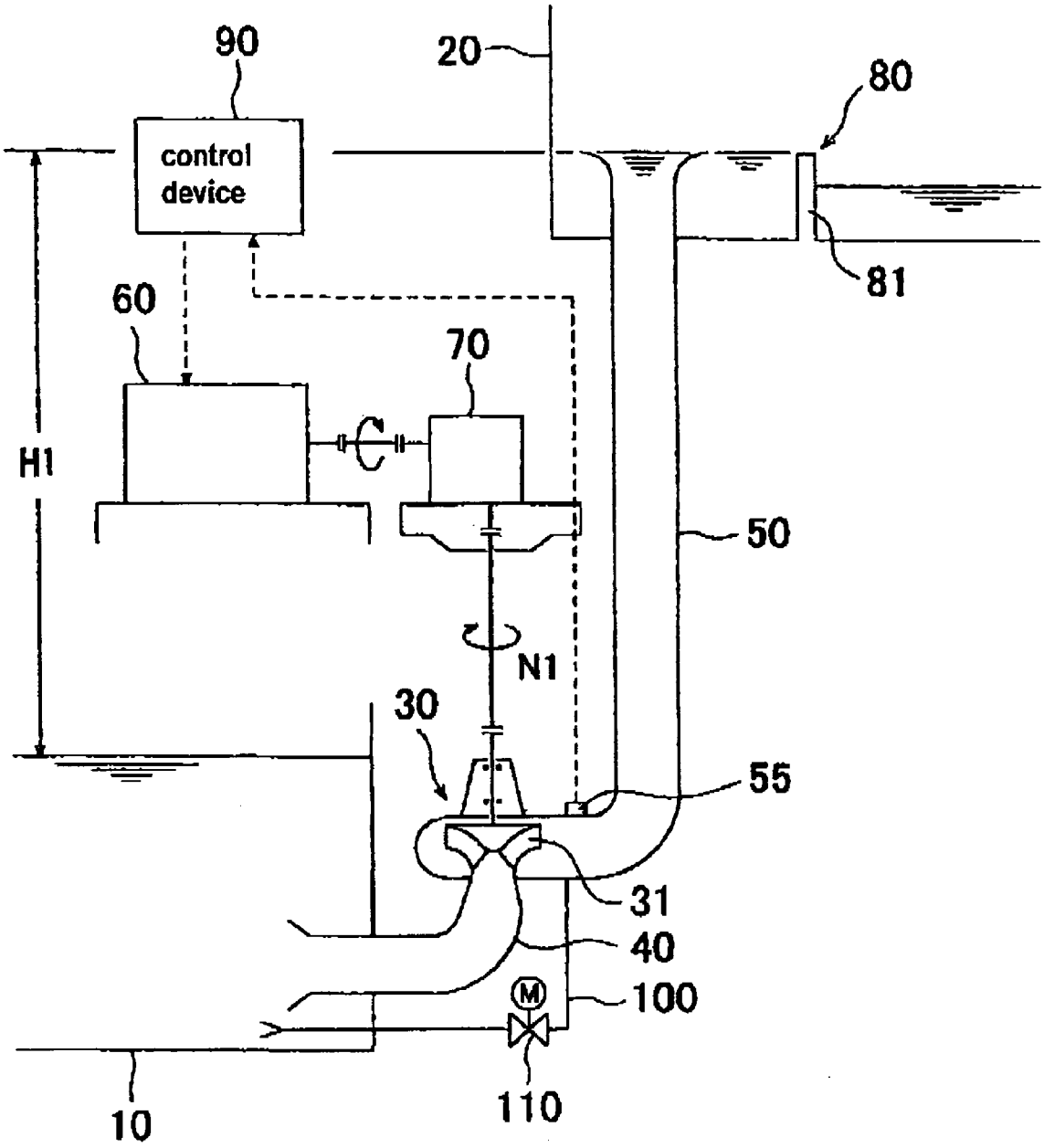
FIG. 9A is a view of the water-lifting pump apparatus shown in FIG. 8, showing the manner in which the pump rotational speed is reduced from N0 to N1.

For finishing the above pumping process for the reason that the water level in the suction tank 10 drops to predetermined water level, the control device 90 opens the back flow rate regulating valve 110 to a predetermined opening, allowing the water in the discharge piping 50 to fall into the suction tank 10 through the bypass piping 50. At the same time, the control device 90 reduces the rotational speed of the impeller 31 of the pump 30 from N0 (rotation in the normal direction) to N1 (rotation in the normal direction) (N0>N1) to bring the water level of the water in the discharge piping 50 into alignment with a water level that fills the discharge port of the discharge piping 50 (the water level difference H1), as shown in FIG. 9A. Stated otherwise, the control device 90 causes water to fall through the bypass piping 100 and, simultaneously, controls the rotational speed of the impeller 31 so that water level in the discharge piping 50 is the same as the water level that fills the discharge port.

Figure 9B:
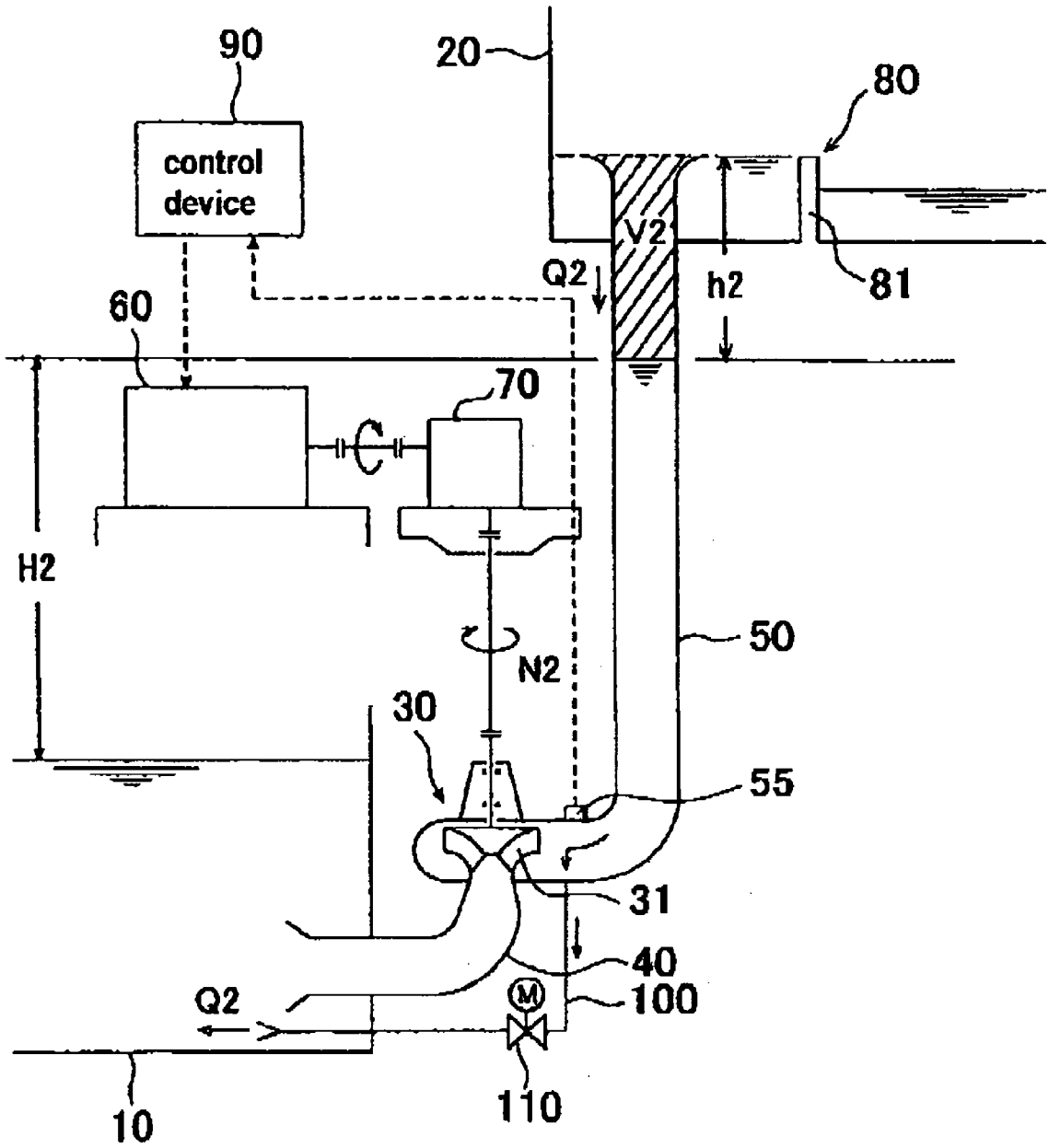
FIG. 9B is a view of the water-lifting pump apparatus shown in FIG. 8, showing the manner in which the pump rotational speed is reduced from N1 to N2.

If the pressure detector 55 detects when the water level difference between the water level in the discharge piping 50 and the water level in the suction tank 10 becomes H1, then the control device 90 adjust the opening of the back flow rate regulating valve 110 for a predetermined back flow rate and, simultaneously, reduces the rotational speed of the impeller 31 of the pump 30 from N1 (rotation in the normal direction) to N2 (rotation in the normal direction) (N1>N2), as shown in FIG. 9B. The water level of the water in the discharge piping 50 is lowered further by a water head drop h2, causing as much water as the water head drop h2 (total reverse flow volume V2) to flow back at a back flow rate Q2 into the suction tank 10 through the bypass piping 100. The water level difference between the water level of the water in the discharge piping 50 and the water level of the water in the suction tank 10 now becomes H2 (H1>H2).

Figure 10A:
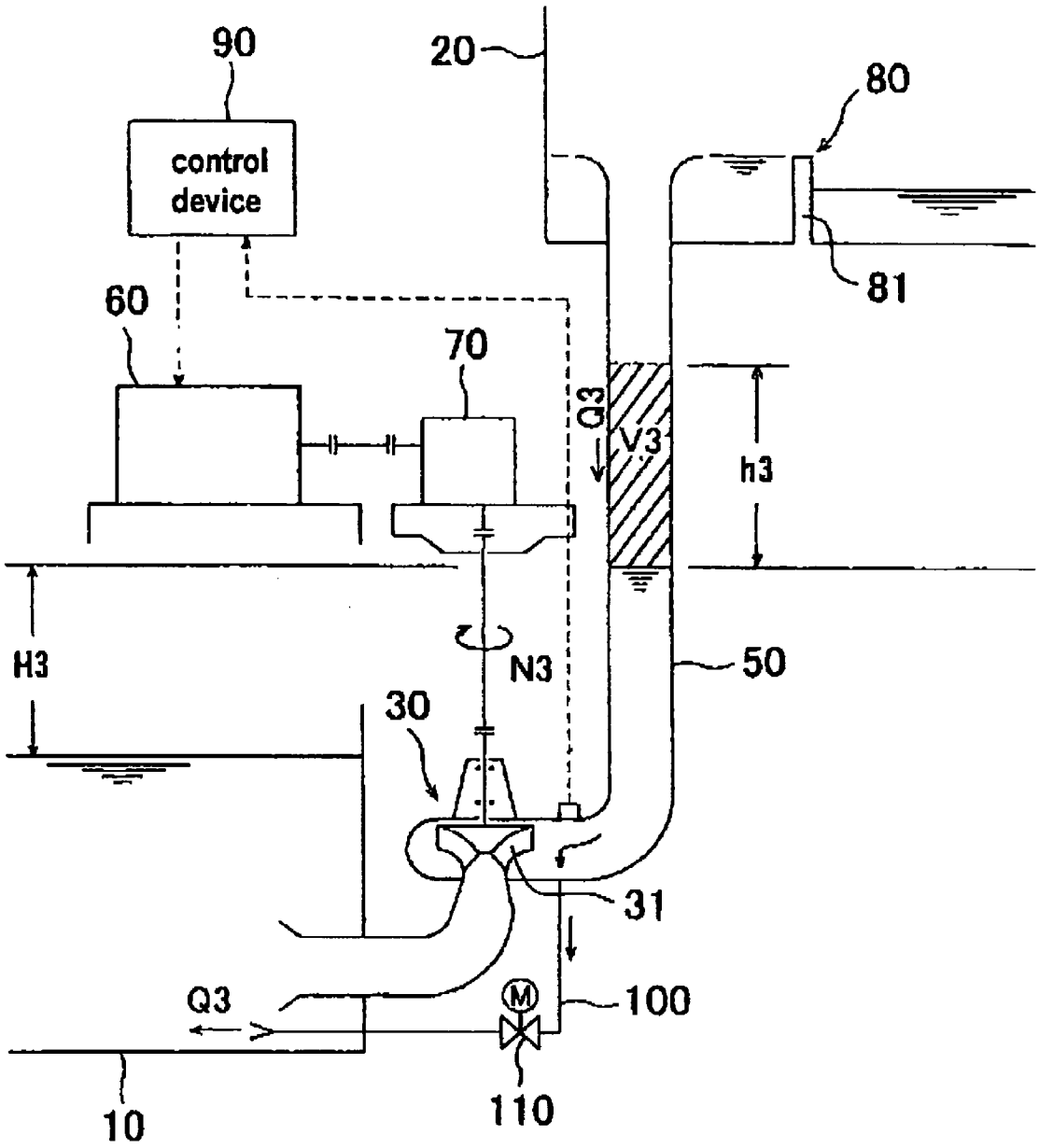
FIG. 10A is a view of the water-lifting pump apparatus shown in FIG. 8, showing the manner in which the pump rotational speed is reduced from N2 to N3.

Similarly, if the pressure detector 55 detects when the water level difference between the water level in the discharge piping 50 and the water level in the suction tank 10 becomes H2, then the control device 90 adjusts the opening of the back flow rate regulating valve 110 for a predetermined back flow rate and, simultaneously, reduces the rotational speed of the impeller 31 of the pump 30 from N2 (rotation in the normal direction) to N3 (rotation in the normal direction) (N2>N3), as shown in FIG. 10A. The water level of the water in the discharge piping 50 is further lowered by a water head drop h3, causing as much water as the water head drop h3 (total reverse flow volume V3) to flow back at a back flow rate Q3 into the suction tank 10 through the bypass piping 100. The water level difference between the water level of the water in the discharge piping 50 and the water level of the water in the suction tank 10 now becomes H3 (H2>H3).

Figure 10B:
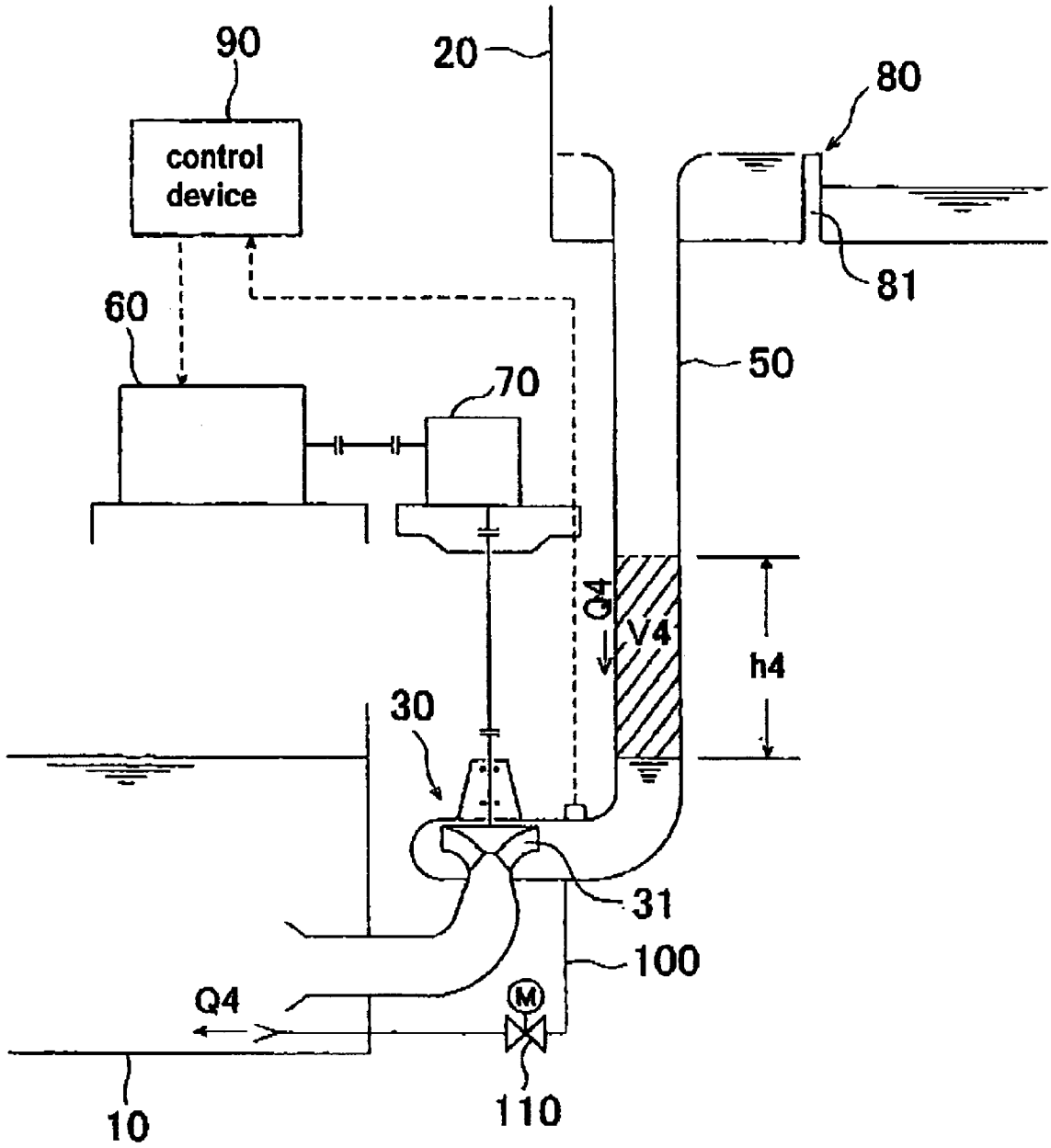
FIG. 10B is a view of the water-lifting pump apparatus shown in FIG. 8, showing the manner in which the pump rotational speed is reduced from N3 to zero.

If the pressure detector 55 detects when the water level difference between the water level in the discharge piping 50 and the water level in the suction tank 10 becomes H3, then the control device 90 adjusts the opening of the back flow rate regulating valve 110 for a predetermined back flow rate and, simultaneously, gradually stops the impeller 31 of the pump 30 against rotation, causing as much water as the water level difference H3 to flow back into the suction tank 10 through the bypass piping 100, as shown in FIG. 10B. The water level difference between the water level of the water in the discharge piping 50 and the water level of the water in the suction tank 10 now becomes 0. Thereafter, the back flow rate regulating valve 110 is closed.

The above controlling method as plotted on pump complete characteristic curves is illustrated in the same fashion as FIG. 6, and will not be described in detail below. According to the above controlling method, a stepwise control process is carried out to lower the water level stepwise in the discharge piping 50 while stopping the water level at a plurality of positions. Alternatively, a continuous control process may be carried out to lower the water level continuously in the discharge piping 50. According to the continuous control process, the opening of the back flow rate regulating valve 110 may be continuously adjusted for a predetermined back flow rate and, simultaneously, the rotational speed of the pump 30 as it rotates in the normal direction may be continuously lowered gradually to continuously lower the water level gradually in the discharge piping 50. The controlling method as plotted on pump complete characteristic curves is illustrated in the same fashion as FIG. 7, and will not be described in detail below.

By thus controlling the back flow rate at which water falls in the discharge piping 50, no water flows back in the pump 30, and hence the actuating means 60 is not reversed, so that an internal combustion engine, which is not allowed to rotate reversely to a large extent, can be used as the actuating means 60. Even if the water-lifting pump apparatus is installed in a deep subterranean region and has a large pump head, the energy of the waterfall has a reduced effect on the pump 30 and the suction piping 40 and the discharge piping 50, or the civil engineering structure associated with the pump 30, and hence produces reduced vibration and noise.

In the above embodiment, all the waterfall flows back through the bypass piping 100 into the suction tank 10, but not through the pump 30, preventing vibrations from being increased by reverse water flow in the pump 30. However, the waterfall may, of course, flow mainly through the bypass piping 100, and may flow partly through the pump 30 at such a rate that vibrations and an amount of generated cavitation will not impair the operation of the water-lifting pump apparatus.

Figure 11:
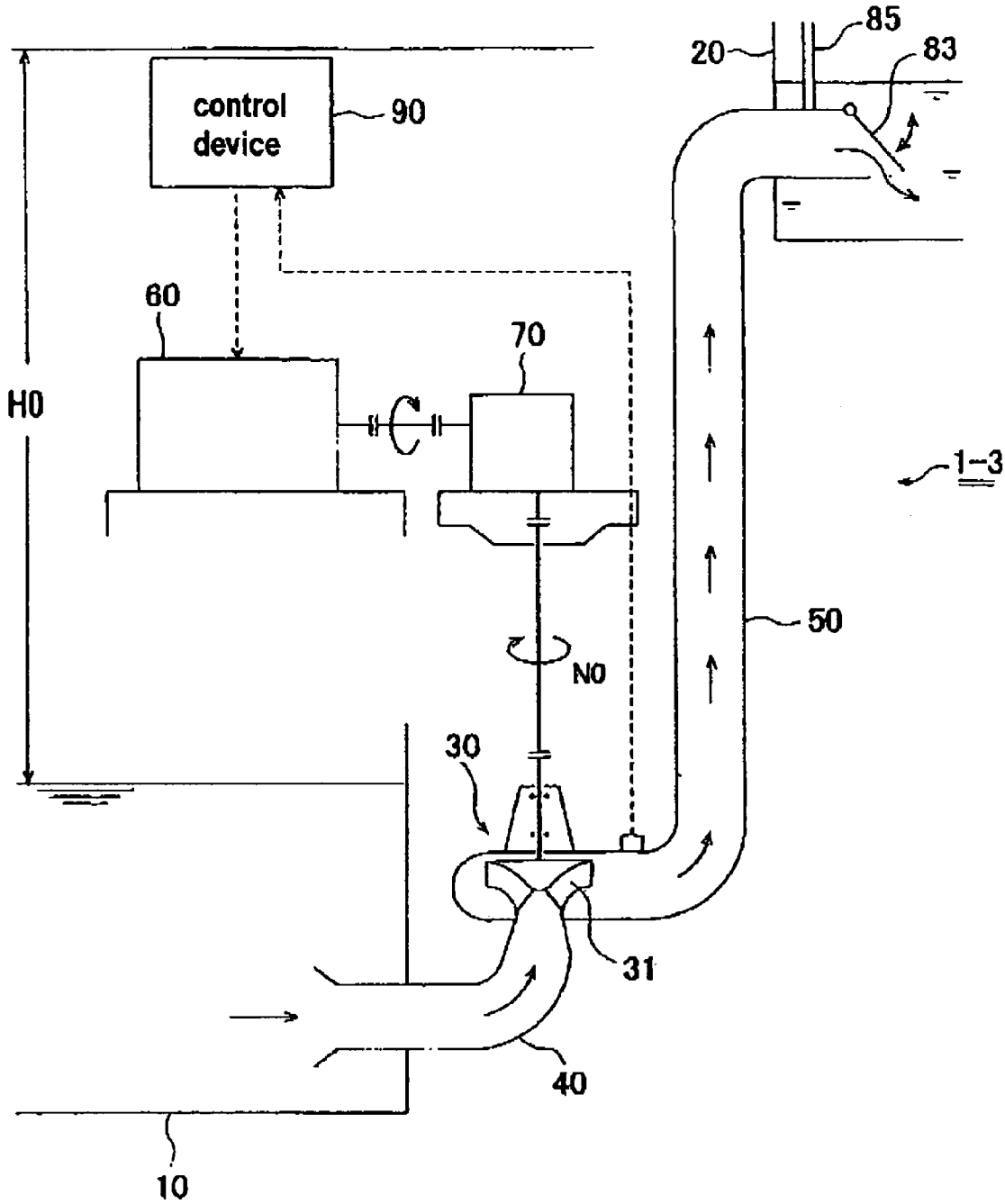
FIG. 11 is an overall schematic view of a water-lifting pump apparatus according to still another embodiment of the present invention.

FIG. 11 is an overall schematic view of a water-lifting pump apparatus 1-3 according to still another embodiment of the present invention. Those parts of the water-lifting pump apparatus 1-3 shown in FIG. 11, which are identical to those of the water-lifting pump apparatus 1-1, are denoted by identical reference characters, and will not be described in detail below. The water-lifting pump apparatus 1-3 differs from the water-lifting pump apparatus 1-1 in that rather than the overflow mechanism 80, a reverse flow prevention valve 83 is mounted as a reverse flow preventing mechanism on the distal end of the discharge piping 50 for preventing the water pumped in the discharge tank 20 against flowing back into the discharge piping 50. An air introduction piping 85 is connected to the discharge piping 50 near its distal end for introducing air required to allow the water in the discharge piping 50 to fall while the reverse flow prevention valve (the reverse flow preventing mechanism) 83 is being closed. With the reverse flow preventing mechanism being thus constructed, when the reverse flow prevention valve 83 is closed while the pump is being shut off, the water pumped in the discharge tank 20 is prevented from flowing back into the discharge piping 50. Since the reverse flow prevention valve (the reverse flow preventing mechanism) 83 is mounted on the end of the discharge piping 50, it may comprise an inexpensive valve of a simple structure such as a flap valve or the like.

Figure 12:
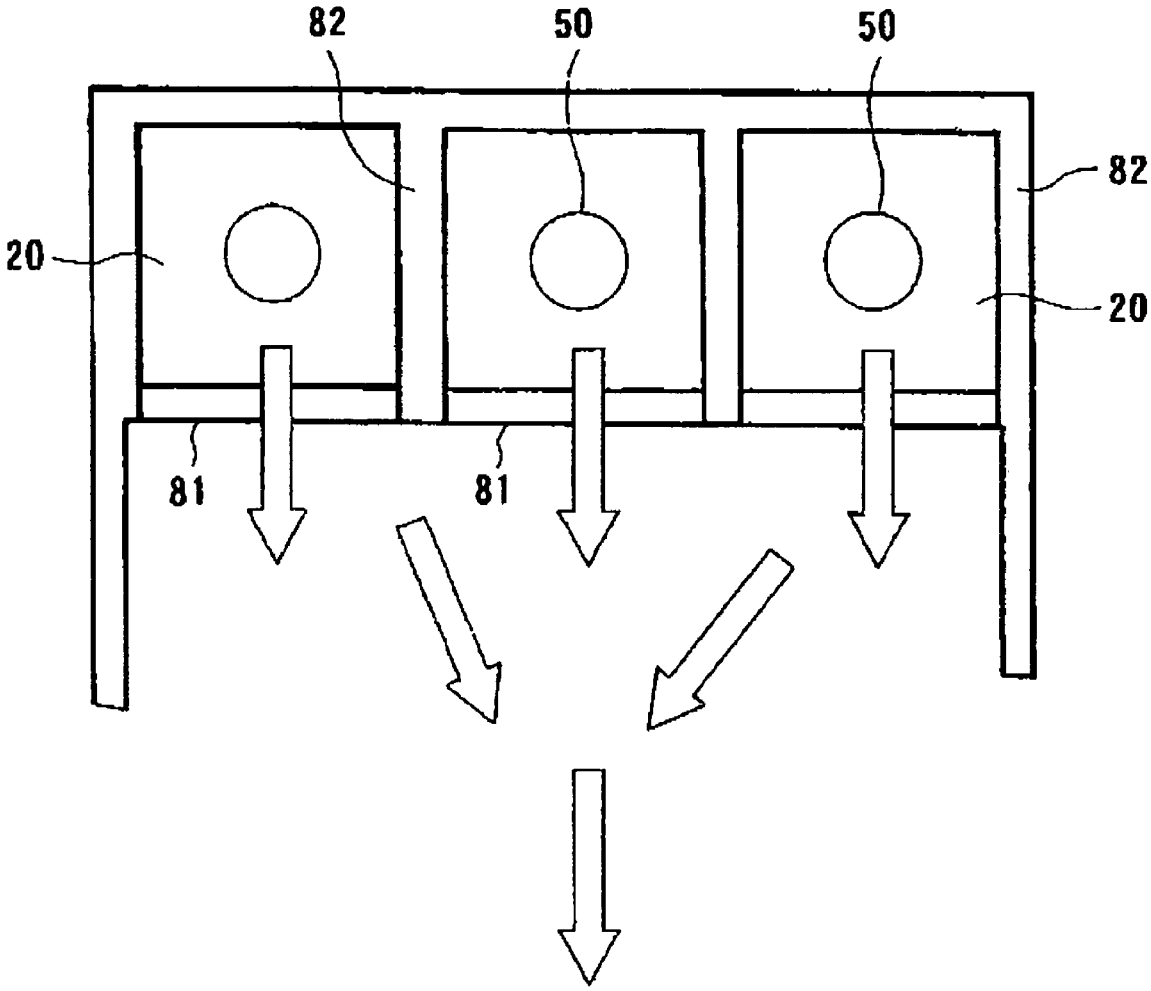
FIG. 12 is a plan view showing an example in which a plurality of pumps are disposed parallel to each other for pumping water.

FIG. 12 shows an example in which a plurality of (three as shown) pumps 30 (see FIG. 3) are disposed parallel to each other for pumping water. In this example, water is pumped through discharge pipings 50 connected to the respective pumps 30 into respective discharge tanks 20, and the water pumped into the discharge tanks 20 overflows respective dams 81 and is drained to a drainage destination. Each of the discharge tanks 20, which are rectangular in shape, has three sidewalls 82, except the dam 81, which are higher than the dam 81. Therefore, the water pumped into each of the discharge tanks 20 overflows only the dam 81 without overflowing the sidewalls 82.

When one of the pumps 30 is shut off, the water pumped by the operating pumps 30 and pumped into the discharge tanks 20 is prevented from overflowing the sidewalls 82 into the discharge tank 20 into which the water pumped by the shut-off pump 30 flowed, and hence from flowing back into the discharge piping 50 that is connected to the shut-off pump 30.

Figure 13:
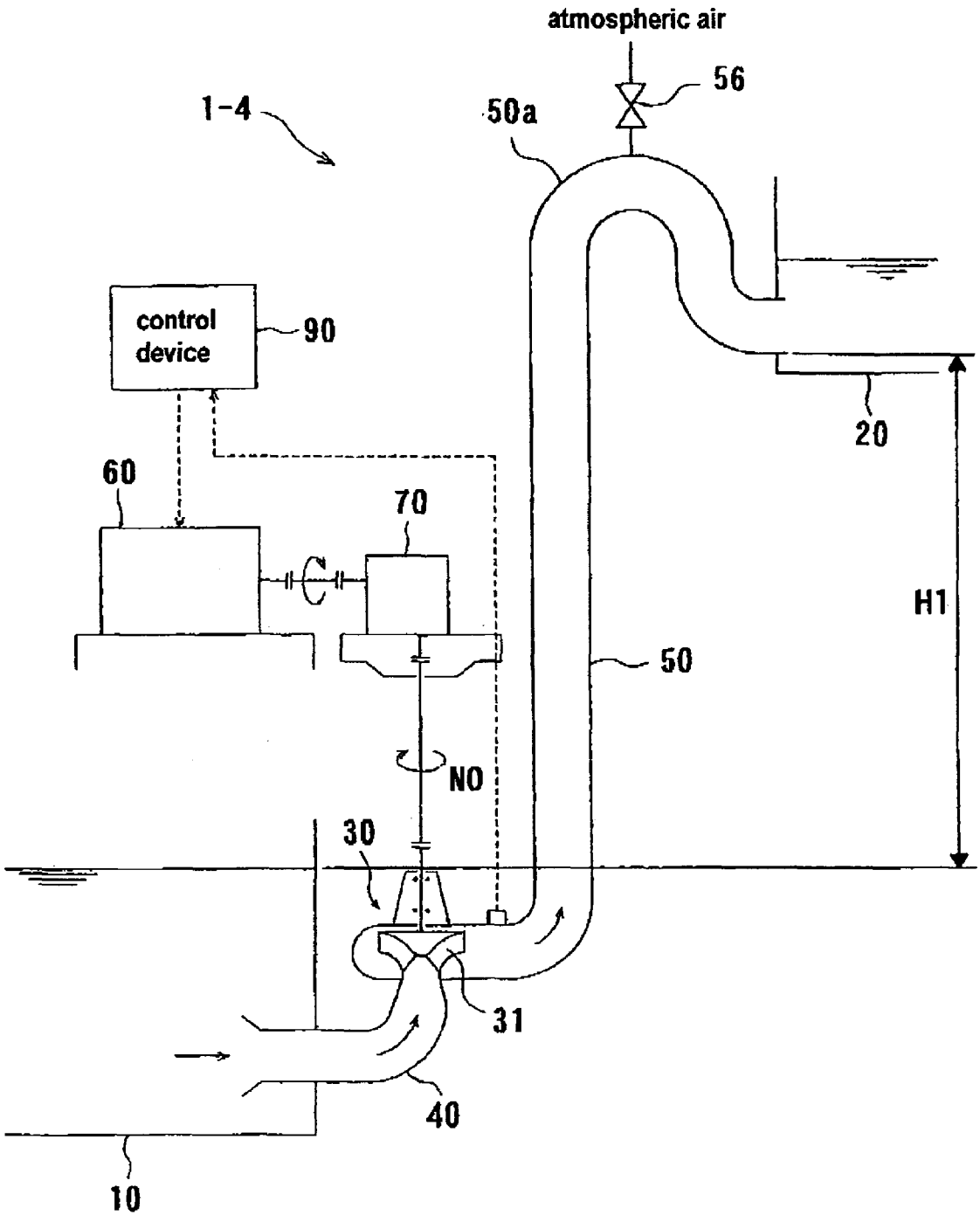
FIG. 13 is an overall schematic view of a water-lifting pump apparatus according to still another embodiment of the present invention.

FIG. 13 is an overall schematic view of a water-lifting pump apparatus 1-4 according to still another embodiment of the present invention. Those parts of the water-lifting pump apparatus 1-4 shown in FIG. 13, which are identical to those of the water-lifting pump apparatus 1-1, are denoted by identical reference characters, and will not be described in detail below. The water-lifting pump apparatus 1-4 differs from the water-lifting pump apparatus 1-1 in that rather than the overflow mechanism 80, a U-shaped siphonic piping 50*a* projecting upwardly is disposed as a reverse flow preventing mechanism in the discharge piping 50, with a siphon break valve 56 being connected to the crest of the siphonic piping 50*a*, for preventing water pumped in the discharge tank 20 from flowing back into the discharge piping 50.

In the present embodiment, when the pumping process is finished, the siphon break valve 56 is opened to introduce atmospheric air into the siphonic piping 50*a*, causing a siphon break thereby to prevent water pumped in the discharge tank 20 from flowing back into the discharge piping 50. As with the embodiments described above, the rotational speed of the pump 30 is lowered to cause the water in the discharge piping 50 to flow back into the suction tank 10, thereby preventing the remaining water in the discharge piping 50 from falling freely. Therefore, an internal combustion engine (a diesel engine, a gas turbine, or the like) can be used as the actuating means 60.

Figure 14:
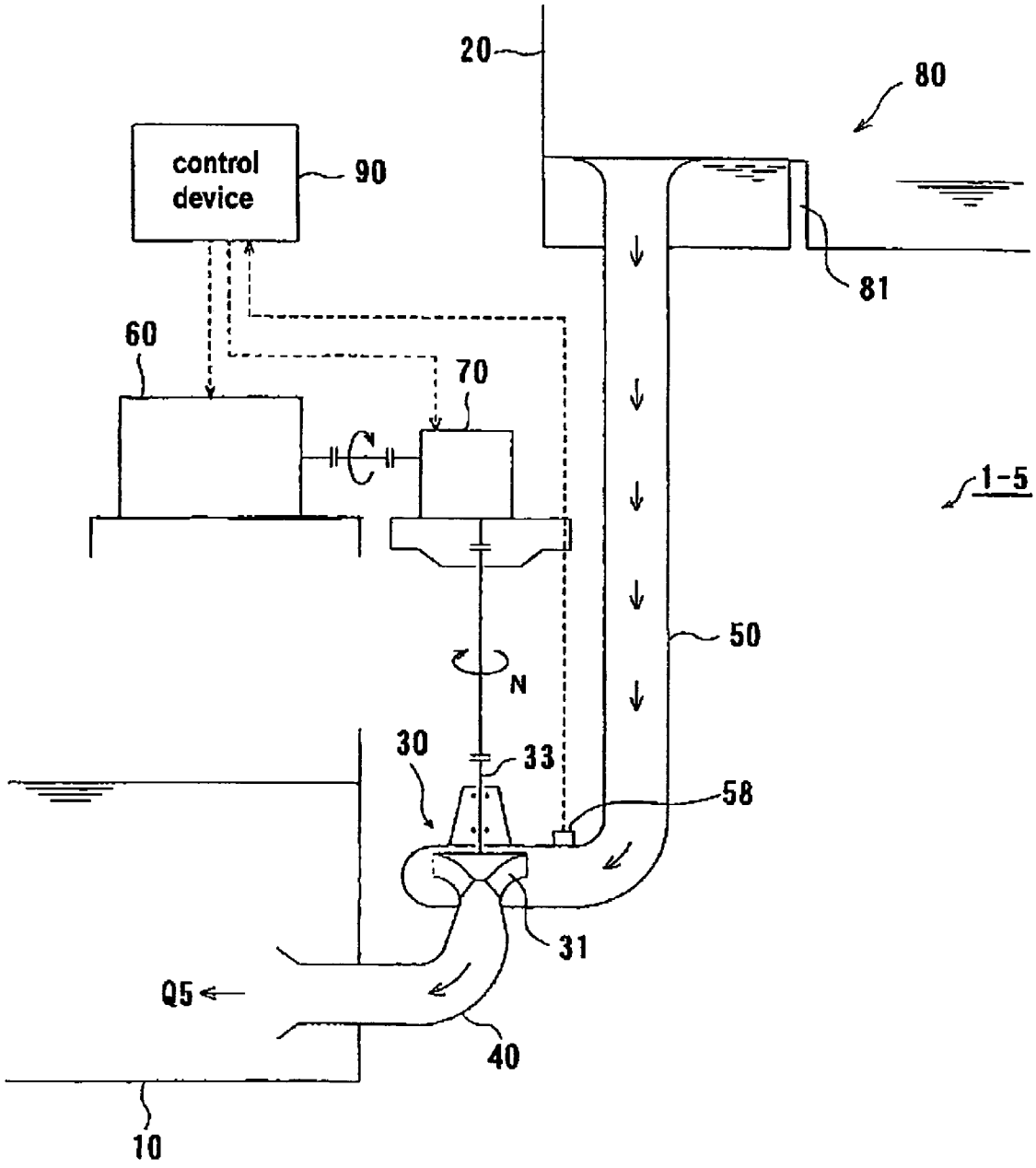
FIG. 14 is an overall schematic view of a water-lifting pump apparatus according to still another embodiment of the present invention.

FIG. 14 is an overall schematic view of a water-lifting pump apparatus 1-5 according to still another embodiment of the present invention. Those parts of the water-lifting pump apparatus 1-5 shown in FIG. 14, which are identical to those of the water-lifting pump apparatus 1-1, are denoted by identical reference characters, and will not be described in detail below. The water-lifting pump apparatus 1-5 differs from the water-lifting pump apparatus 1-1 in that rather than the pressure detector 55 for detecting the pressure in the discharge piping 50 and converting the detected pressure into a water level (difference), a flow rate meter 58, which comprises an ultrasonic flow rate meter, for example, for detecting a flow rate of water flowing back in the discharge piping 50, is disposed on a lower portion of the discharge piping 50, and the flow rate of water flowing back through the discharge piping 50 and the pump 30 into the suction tank 10 is controlled based on the flow rate detected by the flow rate meter 58.

According to the present embodiment, after the pumping operation is finished, the control device 90 gradually reduces the rotational speed N of the impeller 31 of the pump 30 from N0 (rotation in the normal direction) until the flow rate (reverse flow rate) of water flowing in the discharge piping 50 toward the suction tank 10 becomes Q5. The reverse flow rate Q5 is set to such a flow rate that vibrations and the amount of generated cavitation will not impair the operation of the water-lifting pump apparatus even if water flows through the pump 30. When the water in the discharge tank 20 or the discharge piping 50 flows back through the pump 30, the water level in the discharge tank 20 or the discharge piping 50 is lowered. As the water level is lowered, the rotational speed N of the impeller 31 of the pump 30 is lowered to keep the reverse flow rate Q5 constant. The pump 30 is shut off when the reverse flow rate becomes zero, i.e., when all the water in the discharge piping 50 flows back into the suction tank 10.

Figure 15:
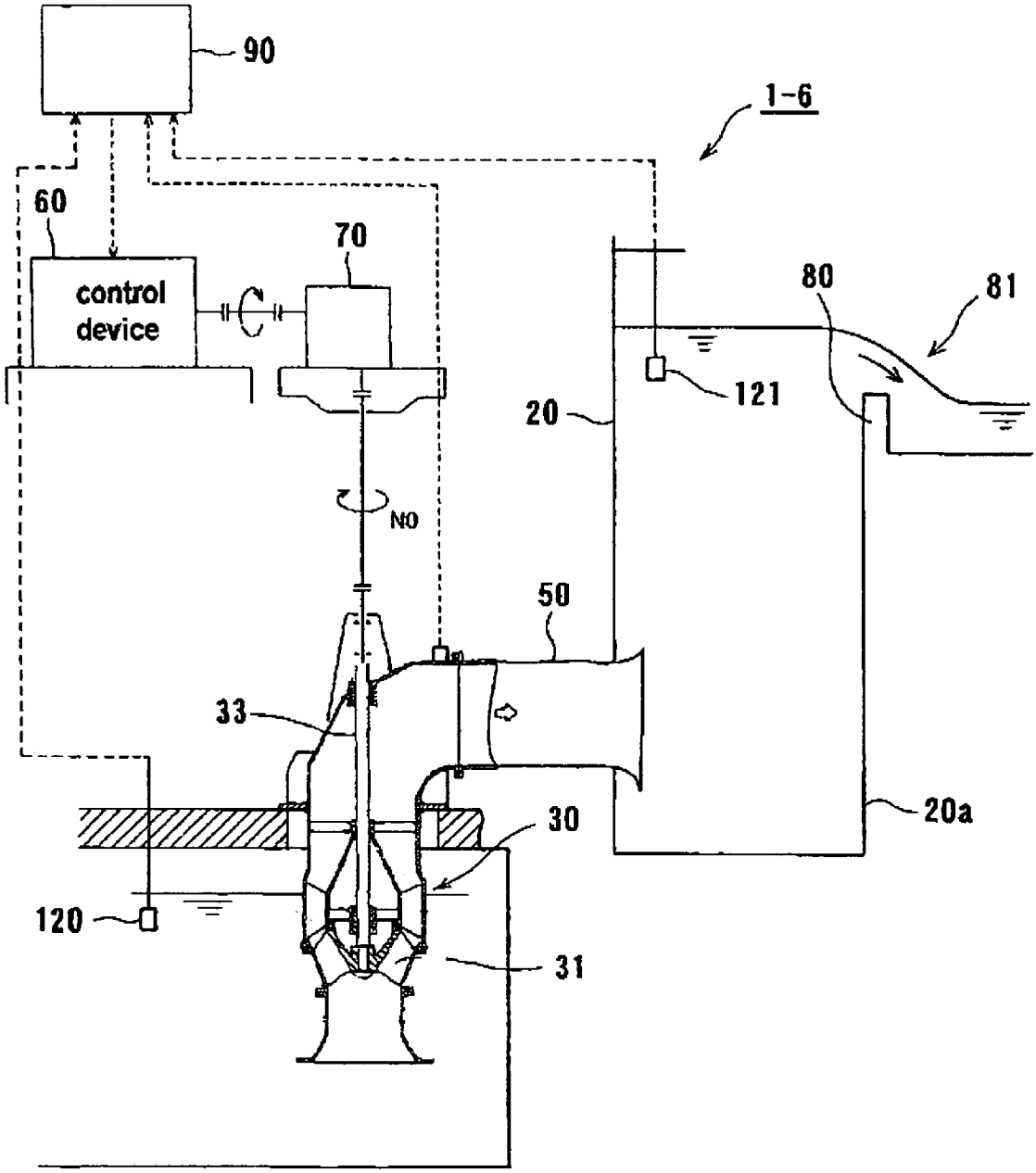
FIG. 15 is an overall schematic view of a water-lifting pump apparatus according to still another embodiment of the present invention.

FIG. 15 is an overall schematic view of a water-lifting pump apparatus 1-6 according to still another embodiment of the present invention. Those parts of the water-lifting pump apparatus 1-6 shown in FIG. 15, which are identical to those of the water-lifting pump apparatus 1-1, are denoted by identical reference characters, and will not be described in detail below. The water-lifting pump apparatus 1-6 differs from the water-lifting pump apparatus 1-1 in that the pump 30 comprises a mixed-flow/axial-flow pump having an impeller 31 extending substantially axially, and water pumped upon rotation of the pump (mixed-flow pump) 30 flows through a discharge piping 50 which extends vertically and is bent perpendicularly into the discharge tank 20 through the side of a pit 20*a* disposed at the bottom of the discharge tank 20. According to the present embodiment, furthermore, the water-lifting pump apparatus has a water level meter 120 for detecting the water level in the suction tank 10 and a water level meter 121 for detecting the water level in the pit 20*a* of the discharge tank 20, and signals from these water level meters 120, 121 are input to the control apparatus 90, which detects the water level difference between the water level in the pit 20*a* of the discharge tank 20 and the water level in the suction tank 10.

With the water-lifting pump apparatus 1-6 according to the present embodiment, after the pumping operation is finished, the rotational speed N0 of the impeller 31 of the pump 30 is reduced to lower the water level in the pit 20*a* of the discharge tank 20.

Figure 16:
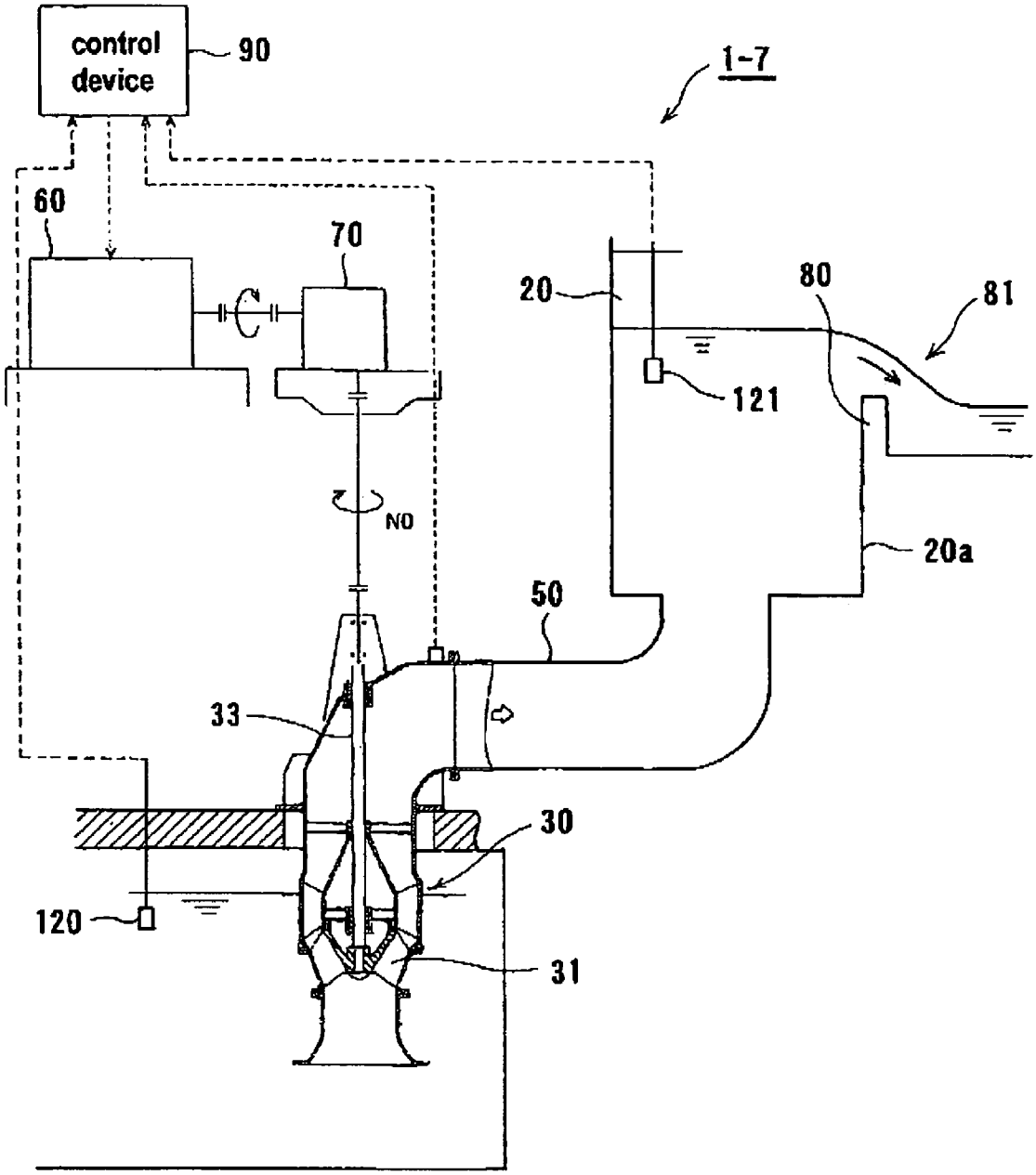
FIG. 16 is an overall schematic view of a water-lifting pump apparatus according to still another embodiment of the present invention.

FIG. 16 is an overall schematic view of a water-lifting pump apparatus 1-7 according to still another embodiment of the present invention. Those parts of the water-lifting pump apparatus 1-7 shown in FIG. 16, which are identical to those of the water-lifting pump apparatus 1-6 shown in FIG. 15, are denoted by identical reference characters, and will not be described in detail below. The water-lifting pump apparatus 1-7 differs from the water-lifting pump apparatus 1-6 in that water pumped upon rotation of the pump(mixed-flow pump) 30 flows through a discharge piping 50 which extends vertically, is bent perpendicularly, and then extends upwardly into the discharge tank 20 through the bottom of the pit 20*a* disposed at the bottom of the discharge tank 20.

With the water-lifting pump apparatus 1-7 according to the present embodiment, a sand deposit on the bottom of the pit 20*a* of the discharge tank 20 flows back through the discharge piping 50 into the suction tank 10, so that the discharge piping 50 is prevented from being closed by sand.

Figure 17A:
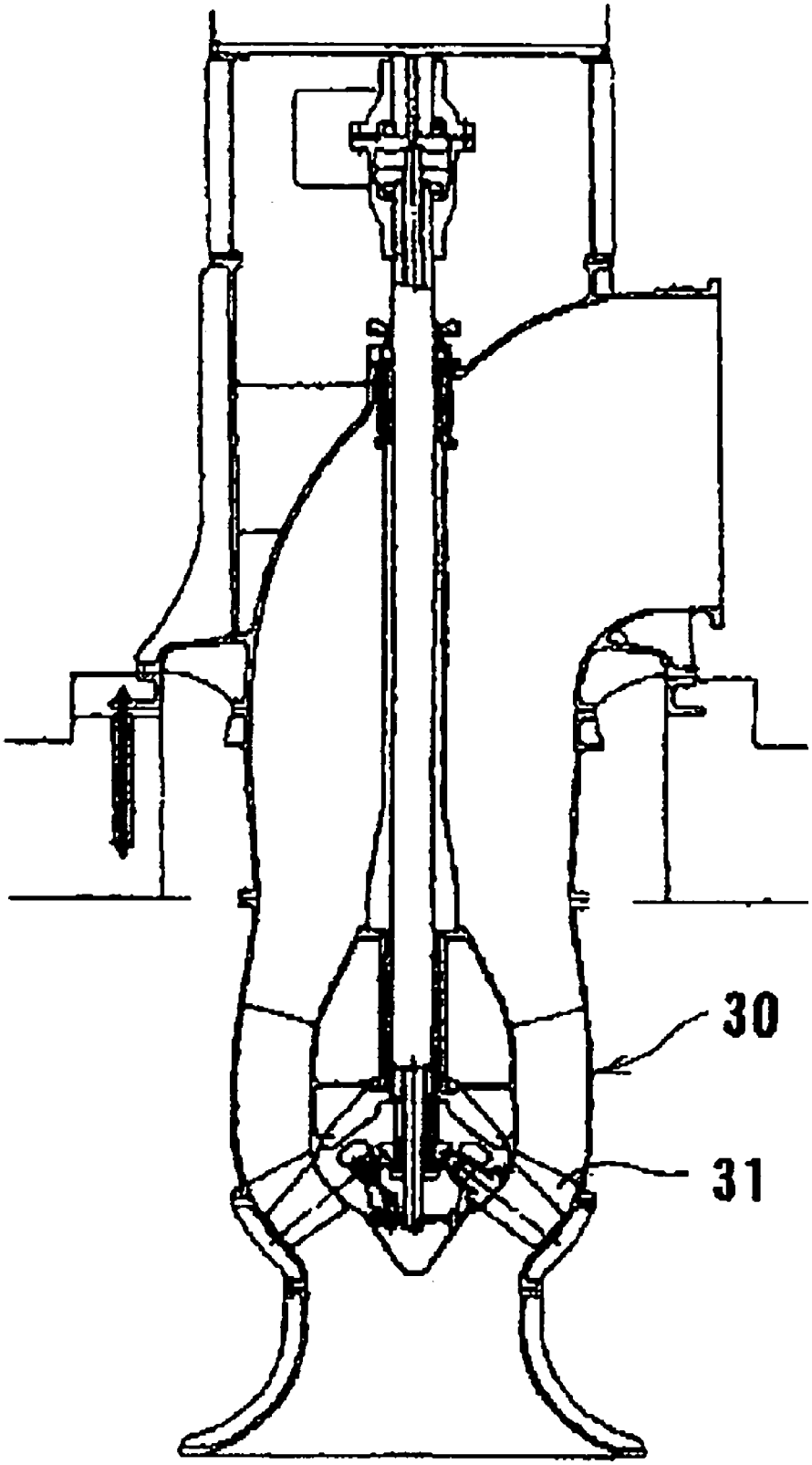
FIG. 17A is a vertical cross-sectional view of a mixed-flow pump having a movable vane mechanism which is capable of adjusting vane angles, used in a water-lifting pump apparatus according to the present invention.
Figure 17B:
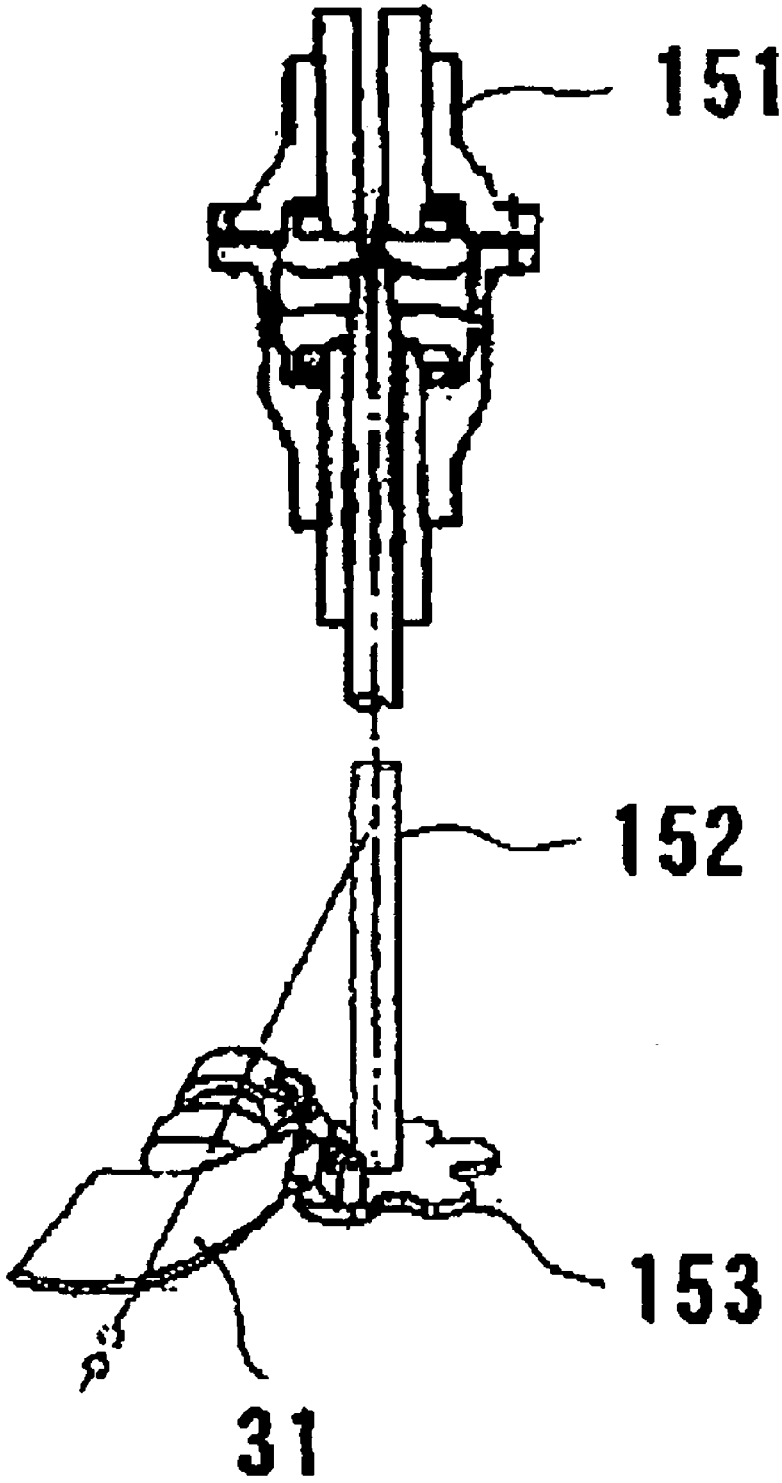
FIG. 17B is a perspective view of the movable vane mechanism shown in FIG. 17A.

The pump (axial-flow pump) 30 according to the embodiments shown in FIGS. 15 and 16, for example, may comprise, as shown in FIGS. 17A and 17B, a servomotor 151, a tension rod 152 vertically movable when the servomotor 151 rotates, and a cross head 153 couple to the lower end of the tension rod 152, and the vane angle of the impeller 31 may be adjustable by the rotation of the cross head 153. By controlling the vane angle of the impeller 31, it is possible to lower the waterfall difference, providing the same effect as if the rotational speed of the pump 30 is lowered, even if the rotational speed of the pump 30 is constant.

Figure 19:
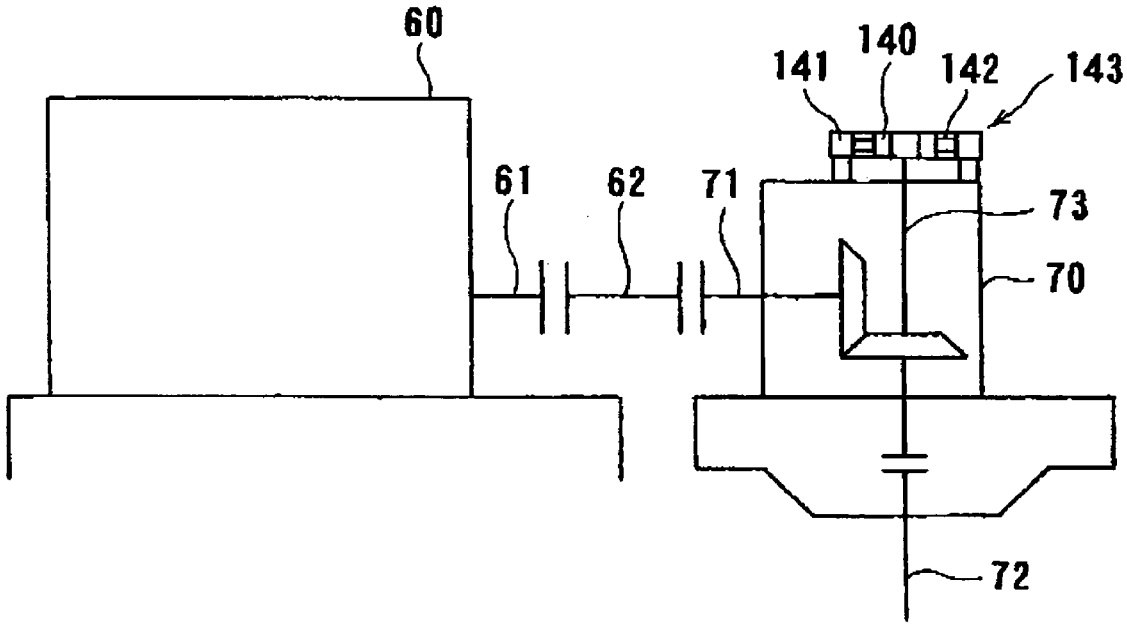
FIG. 19 is a schematic view of another transmission (speed reducer) used in a water-lifting pump apparatus according to the present invention.

In each of the above embodiments, the transmission 70 has the brake 30 as the reversal prevention mechanism, as shown in FIG. 18. However, as shown in FIG. 19, the reversal prevention mechanism may comprise a one-way clutch such as a sprag clutch 143 or the like, rather than the brake, having an inner race 140 fixed to the output shaft 73 of the transmission 70, an outer race 141 fixedly disposed in a position surrounding the circumference of the inner race 140, and sprags 142 disposed between the inner race 140 and the outer race 141 for allowing the inner race 140 to rotate in one direction and preventing the inner race 140 from rotating in the other direction. When the pump 30 is about to rotate reversely, the output shaft 73 of the transmission 70 is locked against rotation by the one-way clutch such as the sprag clutch 143 or the like, thus preventing the actuating means 60, which may be an internal combustion engine or an electric motor, from being reversed.

Figure 20:
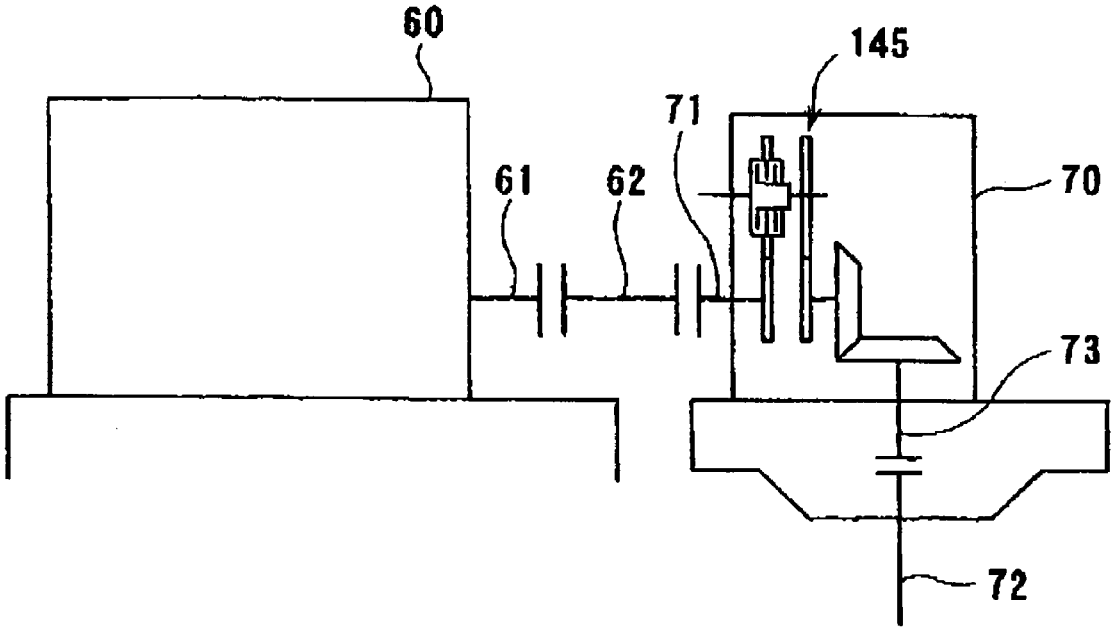
FIG. 20 is a schematic view of still another transmission (speed reducer) used in a water-lifting pump apparatus according to the present invention.

As shown in FIG. 20, the transmission 70 may have a clutch 145 disposed as a reversal prevention mechanism between the input shaft 71 and the output shaft 73 of the transmission 70. In response to e.g. an actuator emergency stop signal or a stop signal from a low-speed detector which is disposed on an actuator shaft for detecting the rotational speed of the actuator shaft, the clutch 145 may be disengaged preventing rotation from the output shaft 73 from being transmitted to the input shaft 71 thereby to prevent the actuating means 60, which may comprise an internal combustion engine or an electric motor, from being reversed, as with above-described brake.

While the embodiments of the present invention have been described above, the present invention is not limited to the above embodiments, but various modifications may be made therein within the scope of claims for patent and the scope of the technical ideas described in the specification and the drawings. Any shapes and structures which operate and offer advantages according to the present invention, even if they are not directly described in the specification and the drawings, fall within the technical ideas of the present invention. For example, through an internal combustion engine has been used as the actuating means 60 in the above embodiments, another actuating means such as an electric motor or the like may be used instead of an internal combustion engine.

In the above embodiments, the overflow mechanism 80 that water discharged from the discharge piping 50 into the discharge tank 20 overflows or the like is used as the reverse flow preventing mechanism. However, a reverse flow preventing mechanism of any of various structures other than the overflow mechanism 80 may be installed insofar as it prevents a reverse flow of water pumped into the discharge tank from flowing back into the discharge piping.

INDUSTRIAL APPLICABILITY

The present invention is concerned with a water-lifting pump apparatus which can be used in a rainwater discharge pump station or the like, is free of a discharge valve and a check valve, is low in cost, and is capable of reducing vibration and noise due to a waterfall after the end of water lifting operation, and a method of controlling operation of the water-lifting pump apparatus.

The invention claimed is:

1. A water-lifting pump apparatus comprising:

a suction tank;

a discharge tank;

a pump for pumping water in said suction tank into said discharge tank, and a discharge piping connected to a discharge side of said pump;

actuating means for driving said pump said actuating means being capable of varying a rotational speed of said pump;

a reverse flow prevention device for preventing a reverse flow of water pumped into said discharge tank toward said discharge piping;

a detector for detecting a pressure or a flow rate of water in said discharge piping or a water level difference between a water level in said discharge tank or said discharge piping and a water level in said suction tank; and a control device for controlling said actuating means to control the rotational speed of said pump, wherein after an end of water pumping operation, said control device controls said pump to maintain rotation at a reduced rotational speed, said reduced rotational speed being based on a detected value of said detector and to allow for water in said discharge piping to fall into said suction tank through said pump.

2. A water-lifting pump apparatus according to claim 1, wherein said reverse flow prevention device comprises an overflow mechanism having a dam disposed in said discharge tank.

3. A water-lifting pump apparatus according to claim 1, wherein said reverse flow prevention device comprises a reverse flow prevention valve disposed on a distal end of said discharge piping.

4. A water-lifting pump apparatus according to claim 1, wherein said reverse flow prevention device comprises a siphonic pipe disposed in said discharge piping.

5. A water-lifting pump apparatus comprising:

a suction tank;

a discharge tank;

a pump for pumping water in said suction tank into said discharge tank, said pump having a movable vane mechanism for adjusting an angle of a vane of an impeller;

a discharge piping connected to a discharge side of said pump;

actuating means for driving said pump. said actuating means being capable of varying a rotational speed of said pump;

a reverse flow prevention device for preventing a reverse flow of water pumped into said discharge tank toward said discharge piping; and a detector for detecting a pressure or a flow rate of water in said discharge piping or a water level difference between a water level in said discharge tank or said discharge piping and a water level in said suction tank; and a control device for controlling said actuating means to control the-rotational speed of said pump and said moveable vane mechanism, wherein after an end of a water pump operation, said control device controls said pump to maintain rotation and adjust the angle of said vane based on a detected value of said detector to allow for water in said discharge piping to fall into said suction tank through said pump.

6. A water-lifting pump apparatus according to claim 1, further comprising:

a reversal prevention device for preventing said actuating means from being reversed.

* * * * *